US007249633B2

(12) United States Patent
Ravensbergen et al.

(10) Patent No.: US 7,249,633 B2
(45) Date of Patent: Jul. 31, 2007

(54) RELEASE TOOL FOR COILED TUBING

(75) Inventors: John Edward Ravensbergen, Calgary (CA); Andre Naumann, Calgary (CA); Lubos Vacik, Calgary (CA); Mitch Lambert, Calgary (CA); Graham Wilde, Calgary (CA)

(73) Assignee: BJ Services Company, Houston, TX (US)

( * ) Notice: Subject to any disclaimer, the term of this patent is extended or adjusted under 35 U.S.C. 154(b) by 280 days.

(21) Appl. No.: 10/868,058

(22) Filed: Jun. 15, 2004

(65) Prior Publication Data

US 2005/0000693 A1 Jan. 6, 2005

Related U.S. Application Data

(63) Continuation-in-part of application No. 10/186,260, filed on Jun. 28, 2002, now Pat. No. 6,832,654.

(60) Provisional application No. 60/302,171, filed on Jun. 29, 2001.

(51) Int. Cl.
*E21B 31/00* (2006.01)

(52) U.S. Cl. ..... 166/301; 166/242.6; 294/86.18

(58) Field of Classification Search ..... 166/377, 166/237, 242.6, 301, 98; 285/2, 3; 294/86.17, 294/86.18, 86.19, 86.21
See application file for complete search history.

(56) References Cited

U.S. PATENT DOCUMENTS 3,902,361 A * 9/1975 Watson ..... 73/152.57
4,246,964 A 1/1981 Brandell ..... 166/106
4,566,535 A 1/1986 Sanford ..... 166/113
4,569,396 A 2/1986 Brisco ..... 166/305.1
4,749,035 A 6/1988 Cassity ..... 166/120
4,815,538 A 3/1989 Burroughs ..... 166/312
4,886,117 A 12/1989 Patel ..... 166/187
5,101,908 A 4/1992 Mody ..... 166/387
5,143,015 A 9/1992 Lubitz et al. ..... 166/187
5,158,142 A * 10/1992 Miszewski et al. ..... 166/377
5,267,617 A 12/1993 Perricone et al. ..... 166/387
5,361,836 A 11/1994 Sorem et al. ..... 166/187

(Continued)

OTHER PUBLICATIONS

SPE 68354 Formation Treating with Coiled-Tubing-Conveyed Straddle Tools; Richard Giroux, et al.

(Continued)

*Primary Examiner*—David Bagnell
*Assistant Examiner*—Daniel P Stephenson
(74) *Attorney, Agent, or Firm*—Howrey LLP

(57) ABSTRACT

A bottom hole assembly for use with fracturing or fracing a wellbore using coiled tubing is described having a first packing element and a second packing element on a mandrel. The bottom hole assembly may be run into the wellbore such that the packing elements straddle the zone to be fraced. Also described is a timing mechanism to prevent the closing of dump ports before the bottom hole assembly may be flushed of the sand. A release tool is described that allows an operator to apply combination of force for a given amount of time to the coiled tubing to dislodge a bottom hole assembly without completely releasing the bottom hole assembly. Also disclosed is a collar locator capable of being utilized in a fracing process. Methods of using the above-described components are also disclosed.

47 Claims, 22 Drawing Sheets

U.S. PATENT DOCUMENTS

| | | | | |
|---|---|---|---|---|
| 5,383,520 | A | 1/1995 | Tucker et al. | 166/142 |
| 5,398,755 | A | 3/1995 | Eslinger et al. | 166/187 |
| 5,568,836 | A * | 10/1996 | Reid | 166/65.1 |
| 5,692,564 | A | 12/1997 | Brooks | 166/127 |
| 5,722,490 | A | 3/1998 | Ebinger | 166/281 |
| 5,782,306 | A | 7/1998 | Serafin | 166/387 |
| 6,196,325 | B1 * | 3/2001 | Connell et al. | 166/377 |
| 6,510,899 | B1 * | 1/2003 | Sheiretov et al. | 166/381 |
| 6,533,037 | B2 | 3/2003 | Eslinger | 166/319 |
| 6,540,025 | B2 * | 4/2003 | Scott et al. | 166/355 |

OTHER PUBLICATIONS

Baski, Inc. web pages at www.baski.com dated Jun. 24, 2002 (7 pages total).

Canadian Office Action dated Dec. 21, 2006. (Canadian Application Serial No. 2,509,468, filed Jun. 8, 2005.)

* cited by examiner

RELEASE TOOL FOR COILED TUBING

CROSS-REFERENCE TO RELATED APPLICATIONS

This application claims priority to the Provisional Application 60/302,171, entitled "Bottom Hole Assembly" filed Jun. 29, 2001, incorporated by reference herein in its entirety, and is a continuation-in-part of patent application Ser. No. 10/186,260, entitled "Bottom Hole Assembly" by Ravensbergen, et al., filed Jun. 28, 2002 now U.S. Pat. No 6,832,654, also incorporated by reference in its entirety herein.

BACKGROUND OF THE INVENTION

1. Field of the Invention

The present invention relates generally to a release tool for use in wellbores. More particularly, this invention relates to a release tool for a bottom hole assembly for use with coiled tubing for the purpose of selectively releasing the bottom hole assembly from the coiled tubing. It should be mentioned that throughout this specification, the term bottom hole assembly may include a single downhole tool, or an assembly of multiple downhole tools, by way of example and not limitation, as would be recognized by one of ordinary skill in the art.

2. Description of the Related Art

In the drilling and production of oil and gas wells, it is frequently necessary to isolate one subterranean region from another to prevent the passage of fluids between those regions. Once isolated, these regions or zones may be fraced as required.

Many stimulation techniques for given types of wells are well suited for use with coiled tubing. Generally, it is known to attach a packing device, such as a straddle packer, to coiled tubing and run the packing device downhole until the desired zone is reached. Once positioned, the fracing proppant or sand slurry may be forced into the zone.

However, utilizing coiled tubing to fracture multiple zones can be problematic. The coiled tubing is generally weaker in tensile and compressive strength than its mechanical counterparts. Thus, coiled tubing may be unable to remove a bottom hole assembly that becomes lodged in the casing. Additionally, fracing facilitates the lodging of the bottom hole assembly in the casing as sand tends to accumulate throughout the bottom hole assembly. Thus, a fracing process which (1) requires multiple fracture treatments to be pumped via the coiled tubing and (2) requires that the bottom hole assembly to be repositioned within the multiple zones between treatments is a collision of objectives.

Additionally, the fracing process may be compromised if the proppant is underflushed such that sand slurry remains within the bottom hole assembly and even the coiled tubing. The additional sand can lodge between the bottom hole assembly and the casing. Consequently the coiled tubing may be partially plugged after each treatment.

Further, in the event that the well's casing integrity is breached, it is possible that proppant could be pumped into the well above the zone being treated, leading to the possibility of the coiled tubing being stuck in the hole. Further, the coiled tubing process requires the use of a zonal isolation tool or bottom hole assembly to be fixed to the downhole end of the coiled tubing. The tool may occupy almost the full cross-sectional area of the well casing which increases the risk of the tool or bottom hole assembly being lodged or stuck in the wellbore casing.

Once the bottom hole assembly becomes lodged, due to excess sand from the proppant becoming lodged between the bottom hole assembly and the wellbore casing, the tensile strength of the coiled tubing generally is not strong enough to be able to dislodge the bottom hole assembly. Therefore, the coiled tubing must be severed from the bottom hole assembly and retracted to surface. The bottom hole assembly must then be fished out of the well bore, or drilled or milled out of the well. These procedures increase the time and cost of fracing a zone.

Coiled tubing operations in deeper wells present another problem to operators trying to retrieve the bottom hole assembly and/or coiled tubing from a deep well. It is known to install release tools between the coiled tubing and the bottom hole assembly. Should it be desired to release the bottom hole tool, e.g. because the bottom hole assembly is irreparably lodged in the casing, an upward force may be applied to the coiled tubing to the release tool. The release tool is designed for the application of a known release force—less than the maximum strength of the coiled tubing—upon which the release tool will release the bottom hole assembly, e.g. by shearing pins in the release tool. For shallow wells, the release force can be established at some given value less than the maximum strength of the coiled tubing.

However, in relatively deep wells, the weight of the coiled tubing detracts from the maximum force that may be applied to the release tool. Thus, the release force cannot be known with certainty. In very deep wells, only a relatively small upward force may be applied to the bottom hole assembly, as the weight of the coiled tubing becomes substantial compared to the maximum force the coiled tubing can withstand. Thus, if the release force is set too low, the bottom hole assembly may be mistakenly released while operating in shallow portions of the well. However, if the release force is set high enough so that the bottom hole assembly will not be inadvertently released in the shallow portion of the well, then, when the bottom hole assembly is at deeper portions of the well, the coiled tubing may not have sufficient strength to overcome the weight of the coiled tubing to apply the required release force. Thus, the bottom hole assembly may become stuck in a deep well and the coiled tubing may not be able to retrieve it.

Fracing with coiled tubing can present yet another problem. In other coiled tubing operations, clean fluids are passed through the coiled tubing. Thus, fluid communication is generally maintained between the bottom hole assembly and the surface via the coiled tubing. However, in the fracing process, sand is pumped through the coiled tubing. The sand may become lodged in the coiled tubing, thus preventing fluid communication between the bottom hole assembly and the surface, thus lessening the likelihood that the bottom hole assembly may become dislodged once stuck.

Additionally, current fracturing work done on coiled tubing typically may experience communication between zones on a not-insignificant number of jobs (e.g. approximately 20% of the jobs). Communication between zones occurs due to poor cement behind the casing. Therefore the sand slurry exits in the zone above the zone being treated instead of into the formation. This sand could build up for some time before the operator realizes what has occurred. This sand build up again may lodge the downhole assembly in the well bore.

Straddle packers are known to be comprised of two packing elements mounted on a mandrel. It is known to run these straddle packers into a well using coiled tubing. Typical inflatable straddle packers used in the industry utilize a valve of some type to set the packing elements. However, when used in a fracing procedure, these valves become susceptible to becoming inoperable due to sand build up around the valves.

One type of straddle packer used with coiled tubing is shown in FIG. 1. This prior art straddle packer 1 comprises two rubber packing elements 2 and 3 mounted on a hollow mandrel 4 (not shown). The packing elements 2 and 3 are in constant contact with casing 10 as the straddle packer is moved to isolate zone after zone.

In operation, the straddle packer 1 is run into the wellbore until the packers 2 and 3 straddle the zone to be fraced 30. Proppant is then pumped through the coiled tubing, into the hollow mandrel 4, and out an orifice 5 in the mandrel 4, thus forcing the proppant into the zone to be fraced 30. This type of straddle packer typically can only be utilized with relatively low frac pressures, in lower temperatures, and in wellbores of shallower depth. Wear on the packing elements 2 and 3 is further intensified when a pressure differential exists across the packer thus forcing the packing elements 2 and 3 to rub against the casing 10 all that much harder.

These prior art packers may be used in relatively shallow wells. Shallow wells are capable of maintaining a column of fluid in the annulus between the mandrel and the casing, to surface. The straddle packer when used to frac a zone is susceptible to becoming lodged in the casing by the accumulation of sand used in the fracing process between the annulus between the mandrel 4 and the casing 10. To prevent the tool from getting lodged, it is possible with these prior art packers used in shallow wells to clean out the sand by reverse circulating fluid through the tool. Fluid is pumped down the annulus, and then reversed back up the mandrel. Because the packing elements 2 and 3 only hold pressure in one direction, the fluid can be driven passed the packing element 2 and into the mandrel and back to surface. Again, this is possible in shallow wells as the formation pressure is high enough to support a column of fluid in the annulus to surface. Otherwise, reverse circulation would merely pump the fluid into the formation.

However, when zones to be fraced are not relatively shallow, the formation pressure is not high enough to support a column of fluid in the annulus from the zone to surface. Thus, the reverse circulation of fluid to remove excess sand from the tool is not possible, again increasing the likelihood that the packer may become lodged in the casing 10.

Further, because a column of fluid in the annulus to surface exists, the operator can monitor the pressure of the column and monitor what is transpiring downhole. However, without this column of fluid, such as in deep wells, the operator has no way of monitoring what is transpiring downhole which further increases the chances of the bottom hole assembly becoming lodged.

Thus, it is desirable to provide safeguards to prevent the bottom hole assembly from becoming stuck in the hole, especially when fracing relatively deep zones with coiled tubing. It is further desired to provide a mechanism by which a lodged bottom hole assembly may be "tugged" by the coiled tubing in an effort to dislodge the bottom assembly, without completely releasing the bottom hole assembly.

Another problem with fracing deeper wells with coiled tubing occurs when sand slurry is pumped through the bottom hole assembly at high flow rates. These high flow rates may cause erosion of the casing. Therefore, there is a need to perform the fracing process with coiled tubing which minimizes the erosion on the casing. Thus, a need exists for a bottom hole assembly capable of fracing using coiled tubing which minimizes erosion to the casing and the bottom hole assembly.

Therefore, there is a need for a bottom hole assembly that is capable of performing multiple fractures in deep wells (e.g. 10,000 ft.). Further, there is a need for the bottom hole assembly that may operate while encountering relatively high pressure and temperature, e.g. 10,000 p.s.i. and 150° C., and relatively high flow rates (e.g. 10 barrels/min.).

The present invention is directed to overcoming, or at least reducing the effects of, one or more of the issues set forth above.

SUMMARY OF THE INVENTION

A bottom hole assembly is described for use with coiled tubing for fracturing a zone in a wellbore having a casing, comprising a hollow mandrel functionally associated with the coiled tubing, the mandrel surrounded by an outer housing, the outer housing and the casing forming an annulus therebetween; an upper packing element; a lower packing element, the upper and lower packing elements disposed around the outer housing such that the packing elements are capable of straddling the zone to be fraced and are capable of setting the bottom hole assembly in the casing when the elements are set; an upper dump port in the outer housing, the upper dump port placing the annulus and a flow path within the hollow mandrel in fluid communication when an upward force is applied to the mandrel via the coiled tubing to deflate the upper and lower packing elements; and a timing mechanism to ensure the fluid communication continues for a predetermined time to prevent the dump port from closing before the bottom hole assembly is flushed.

In some embodiments, a release tool is described for use with coiled tubing to connect a bottom hole assembly with the coiled tubing, the release tool comprising a release tool mandrel associated with a fishing neck housing; and a reset mechanism allowing a user to apply a combination of varying predetermined upward forces to the release tool via the coiled tubing for varying predetermined set of lengths of time without applying sufficient force over time to release the bottom hole assembly from the coiled tubing.

After the combination of varying predetermined upward forces have been applied for the associated amounts of time, additional upward forces or any upward force applied for period of time, may be applied to release the bottom hole assembly from the coiled tubing.

In other embodiments, a collar locator is described. Also described is a method of using the above devices.

Additional objects, features and advantages will be apparent in the written description that follows.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiments presented herein.

Figure 1:
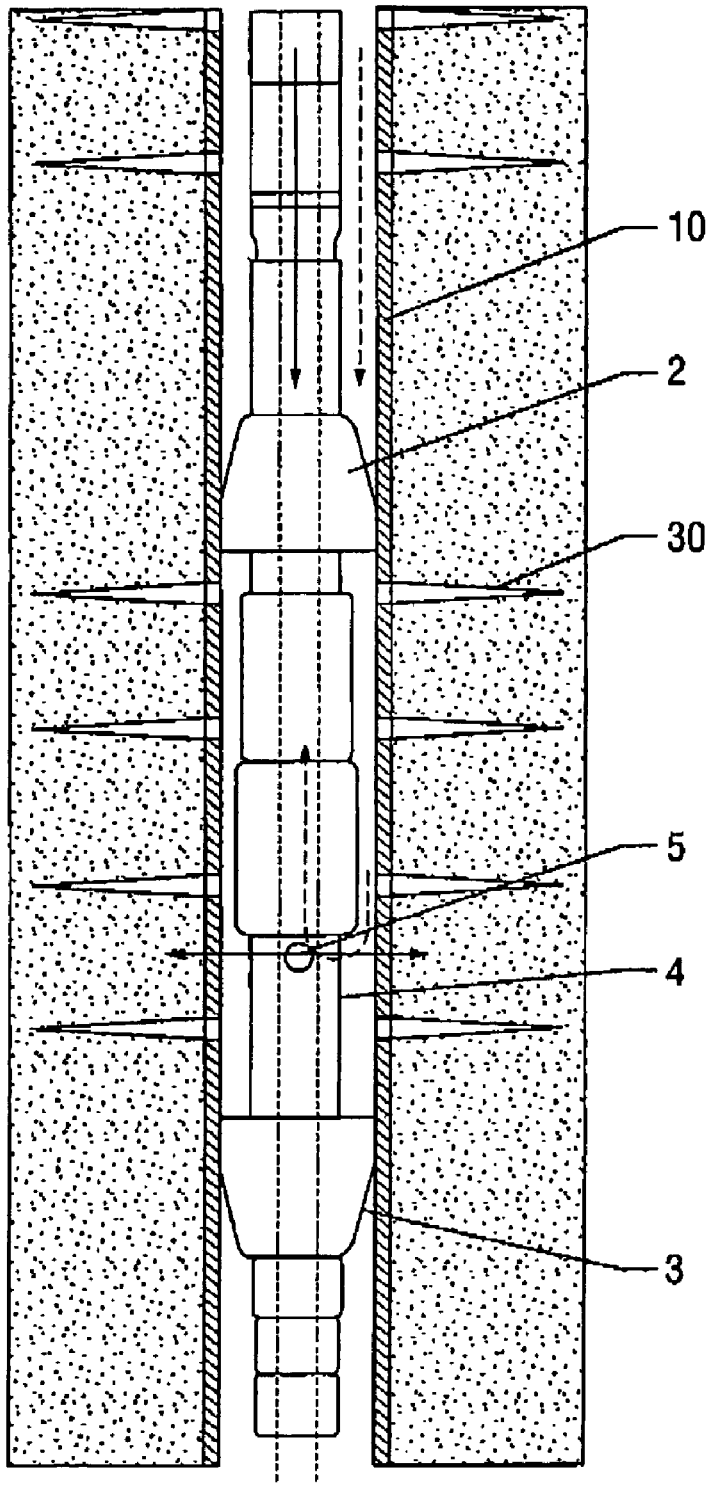
FIG. 1 (Prior Art)
FIG. 1 shows a prior art straddle packer.

While the invention is susceptible to various modifications an alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims. Further, while fracing operations have been described above, the release tool of some embodiments of the present invention is adapted to be utilized in conjunction with any bottom hole assembly, performing any type of operation downhole, known to those of skill in the art.

DESCRIPTION OF ILLUSTRATIVE EMBODIMENTS

Illustrative embodiments of the invention are described below as they might be employed in the fracing operation. In the interest of clarity, not all features of an actual implementation are described in this specification. It will of course be appreciated that in the development of any such actual embodiment, numerous implementation specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

The present embodiments include a bottom hole assembly that may be utilized with coil tubing for the purpose of performing an operation downhole, such as fracturing a well, even a relatively deep well. For example, the embodiments disclosed herein may perform multiple fractures in relatively deep wells (e.g. depths to 10,000 feet). The embodiments disclosed herein may also be utilized with relatively high fracturing pressures (e.g. 10,000 p.s.i.), relatively high temperature (e.g. 150° C.), and relatively high flow rates (e.g. 10 barrels/min.).

Figure 2:
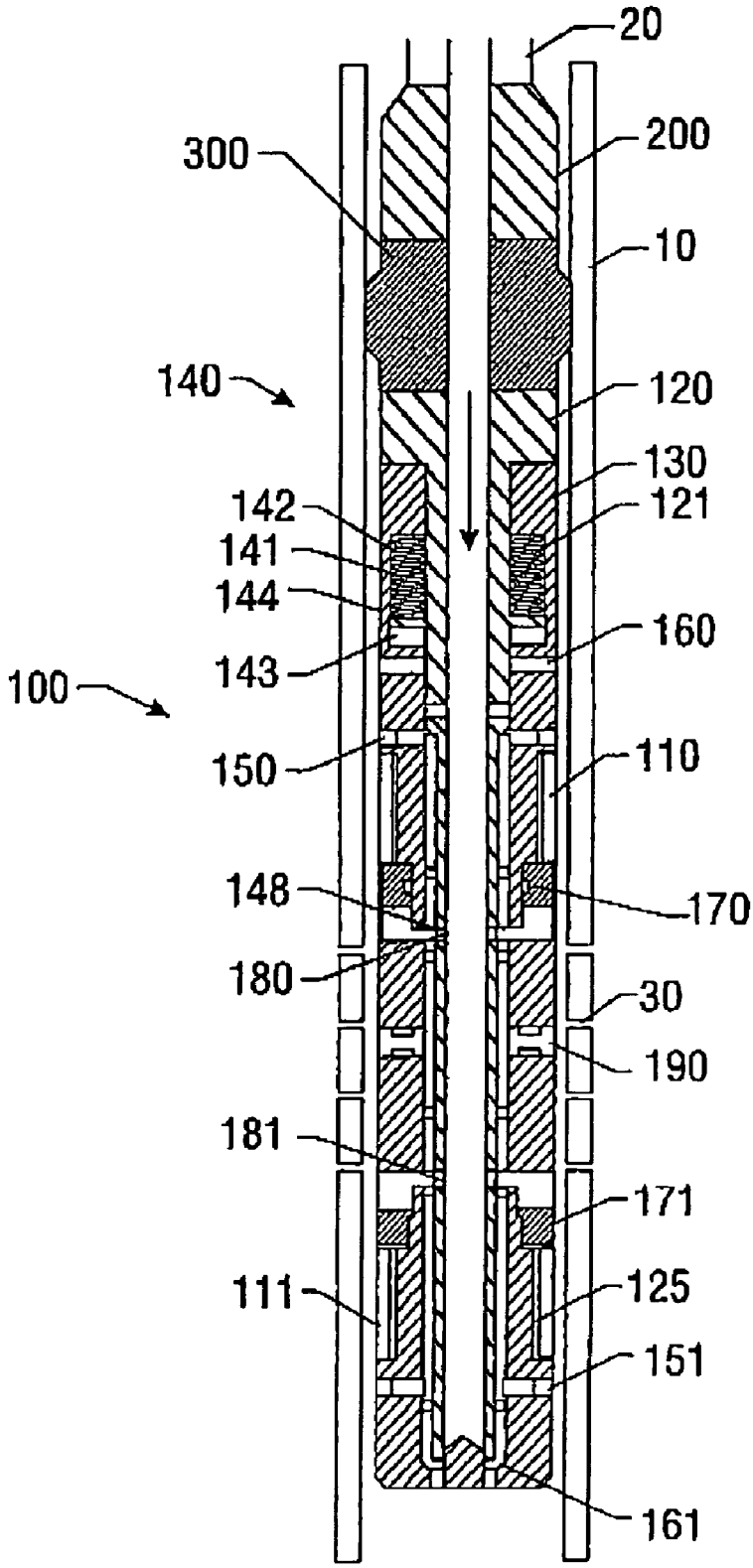
FIG. 2 shows a bottom hole assembly of one embodiment of the present invention having a timing mechanism.

Embodiments of the invention will now be described with reference to the accompanying figures. Referring to FIG. 2, one embodiment of the present invention is shown being utilized downhole within well casing 10. The bottom hole assembly 100 in some embodiments is connected to coiled tubing 20 by a release tool 200, the operation of which is described more fully herein with respect to FIGS. 7–22. A mechanical collar locator 300 may be connected to the release tool 200. The mechanical collar locator 300, described more fully with respect to FIG. 23, may be utilized to position the bottom hole assembly 100 at a desired position in the wellbore, such as near a zone to be fraced 30.

In some embodiments, the collar locator 300 is connected to the mandrel 120 of the bottom hole assembly 100. The mandrel 120 is shown in FIG. 2 circumscribed by outer housing 130 over most of its axial length. Positioned about the mandrel 120 and the outer housing 130 are two packing elements: upper packing element 110 and lower packing element 111. When in position for the fracing of a zone to occur, the upper packing element 110 and the lower packing element 111 straddle the zone to be fraced 30.

The bottom hole assembly 100 may be therefore considered a straddle packer. Further, the upper and lower packing elements 110 and 111 may be inflatable. Further, the upper and lower packing elements 110 and 111 may be formed from highly saturated nitrile (HSN) elastomer to withstand relatively high temperature and pressure applications. These packing elements 110 and 111 are able to withstand relatively high pressures, e.g. up to 10,000 p.s.i., at relatively high temperatures, e.g. 150° C., and may cycle between low and high pressures a minimum of twenty times.

The number of moving parts to perform a given function for the bottom hole assembly 100 shown in FIG. 2 is minimized, as this tool may be used in a fractured Sand Gelled Slurry environment. For instance, instead of using valves of the prior art to inflate packing elements, the upper and lower packing elements 110 and 1111 are inflated by changing the flow rate of the fluid passing through the coiled tubing 20 and through the bottom hole assembly 100.

Also shown in FIGS. 2–6 are upper boost piston 170 and lower boost piston 171, which will be discussed more fully below. The bottom hole assembly 100 may also include top dump port 160 and bottom dump port 161 within outer housing 130, upper and lower filters 180 and 181 respectively, and upper and lower packer equalization ports 150 and 151 respectively. Finally, the bottom hole assembly 100 may include a timing mechanism 140.

In operation, the bottom hole assembly 100 is run into the casing 10 to the desired zone to be fraced 30. This depth may be determined via the mechanical casing collar locator 300 described more fully herein with respect to FIG. 23. The upper and lower packer elements 100 and 111 are set by increasing the flow rate of the fluid passing through the coiled tubing 20 and into mandrel 120 to a rate above the circulating flow rate between the annulus between the outer housing 130 and the casing 10. This increase in flow rate creates a pressure drop across the orifi 190.

This pressure drop inflates the upper and lower packer elements 110 and 111. To facilitate the inflation of the upper and lower packer elements 110 and 111, upper and lower pressure boost pistons 170 and 171 may be utilized. The upper and lower pressure boost pistons 170 and 171 reference the tubing pressure (the pressure outside the bottom hole assembly 100 between the upper and lower packing elements 110 and 111) and the annulus pressure.

Pressure boost pistons 170 and 171 are comprised of a cylinder having a base with a larger axial cross sectional area than its surface. The differential pressure between the tubing pressure and the annulus pressure creates an upward force on the base of the boost piston 170. Similarly, the differential pressure creates a downward force on piston 171. These forces are then supplied to the smaller surface area of the surface of the boost piston to create the pressure boost. This pressure boost assists in keeping the packing elements inflated. Otherwise, as soon as the flow rate through the bottom hole assembly drops to zero, the pressure drop across the orifice goes to zero, and the pressure in the packers is the same as the straddle pressure. With the pressure in the packers equal to the straddle pressure, the packers may leak fluid between the packers and the casing 10. This pressure boost may be approximately 10% of the tubing pressure. The moving pistons can be kept isolated from the dirty fracturing fluids with seals and filters. The volume of fluids passing through the filter is small.

The pressure drop across the orifi 190 to set the upper and lower packing elements 110 and 111 may be done in a blank casing 10 during a pressure test or when straddling the perforated zone 30 during a fracture treatment.

When fracing a zone 30, once the packers are set, sand slurry is then pumped through the coiled tubing 20, through the bottom hole assembly 100 and out orifi 190 and into the zone to be fraced 30. Once the fracing procedure is complete, the packing elements 110 and 111 will be deflated, the bottom hole assembly 100 moved to the next zone, if desired, and the process repeated.

Figure 3:
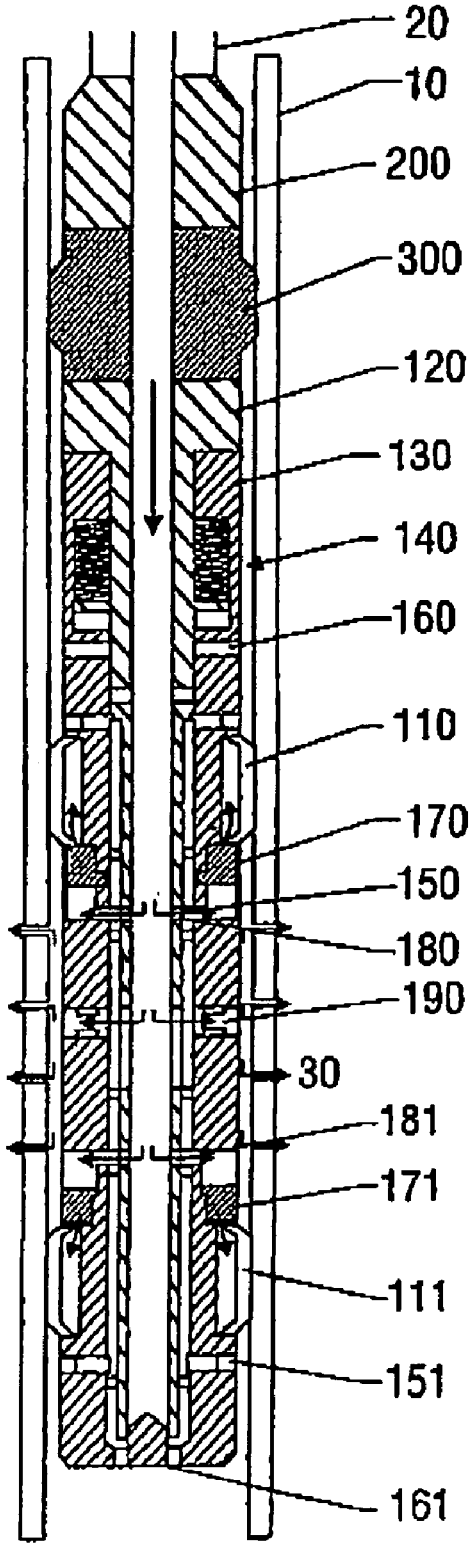
FIG. 3 shows one embodiment of the bottom hole assembly with the packing elements energized to frac the well.

FIG. 3 shows the bottom hole assembly 100 in the set position, i.e., with the packing elements 110 and 111 energized (inflated to contact casing 10) and the sand slurry being pumped down the coiled tubing, through the bottom hole assembly 100, and out the orifi 190 into the zone 30 to be fraced. When inflating the upper and lower packing elements 110 and 111, the flow rate is increased through the fracturing orifi 190 until a pressure differential is created inside the bottom hole assembly 100 to outside the bottom hole assembly 100.

Once the pressure differential across the fracturing orifi 190 is greater than the break out inflation pressure of the inflatable packing elements 110 and 111 (i.e. the pressure needed to inflate the packing elements into contact with the casing 10), the inflatable elements 110 and 111 inflate. As the packing elements 110 and 111 inflate, the pressure drop will continue to increase as the annular flow path (between the outer housing 130 and the casing 10) above and below the bottom hole assembly 100 becomes restricted by the packing elements 110 and 111.

Figure 4:
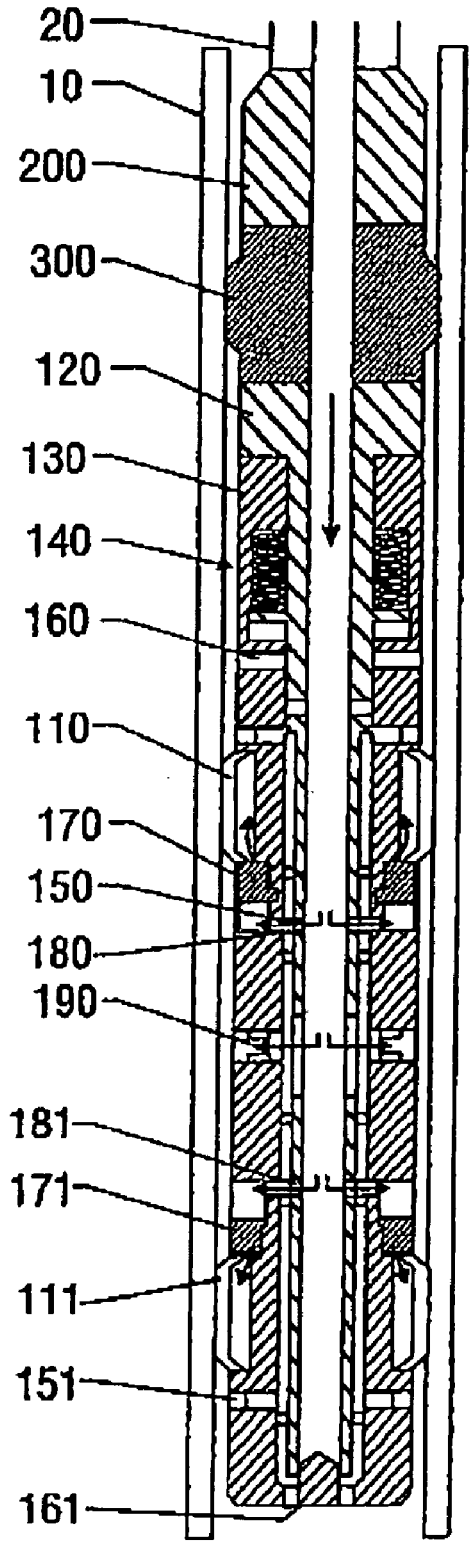
FIG. 4 shows one embodiment of the bottom hole assembly when used in a bottom hole assembly casing pressure test.

Occasionally, it is desired to set the bottom hole assembly 100 in blank casing (as opposed to straddling a zone 30 to be fraced) to test the functionality of the packing elements. The blank casing test of one embodiment of the present invention is shown in FIG. 4. In the event the packing elements 110 and 111 are set in blank casing 10 rather than across the formation with perforations in the casing 10, all flow paths become blocked. For instance, flow down the coiled tubing 20 and through the bottom hole assembly 100 exit orifi 190, then travels through the annulus between the bottom hole assembly 100 and the casing 10 until the flow contacts either upper packing element 110 or lower packing element 111. With no perforations in the casing 10, the flow rate must decrease and stop. When the flow rate stops the pressure differential from inside the bottom hole assembly 100 to outside the bottom hole assembly 100 decreases. In time, the pressure inside and outside the bottom hole assembly 100 (i.e. the straddle pressure and the tubing pressure) will be equal.

Thus, in some embodiments, it is preferred that the pressure inside each packing element 110 and 111 be greater than the downhole pressure between the two packing element (i.e. the straddle pressure). Otherwise, the straddle pressure may force one or both of the packing elements 110 and/or 111 to deflate.

Conventional industry-wide straddle technology achieves this higher pressure inside the packing element by means of a pressure control valve. However, the fracing environment creates problems for the valves over time when resetting the packing elements multiple times.

To minimize sand accumulation, in some embodiments, the outer diameter of the bottom hole assembly 100 is 3½" for a standard 4½" casing 10. The 3½" outer diameter of the bottom hole assembly 100 is small enough to minimize sand bridging between the bottom hole assembly 100 and the casing 10 during the fracing process. Similarly, the outer diameter of the bottom hole assembly 100 may be 4½ for a standard 5½" casing 10. The 4½" outer diameter of the bottom hole assembly 100 is small enough to minimize sand bridging between the bottom hole assembly 100 and the casing 10 during the fracing process. In addition, increasing the cross sectional area of the bottom hole assembly 100 facilitates pressure containment and improves strength.

Also, to minimize the accumulation of sand in the annulus, and as shown in FIGS. 2–6, both the outer diameter and inner diameter of the bottom hole assembly 100 are straight and do not have upsets, as internal and external upsets hamper tool movement when surrounded by sand. The straight outer diameter of the bottom hole assembly 100 and a large annular clearance between the bottom hole assembly 100 and the casing 10 minimizes the likelihood of sand bridges forming and sticking the bottom hole assembly 10 in the well bore.

The annular clearance preferably is greater than ×5 grain particles, even when a heavy wall casing has been used for casing 10 and 16/30 Frac Sand has been used as the proppant.

Preferably, the inflatable upper and lower packing elements 110 and 111 have an outer diameter to match the outer diameter of the bottom hole assembly 100, when the inflatable upper and lower packing elements 110 and 111 are in their deflated state, even after multiple inflations and deflations.

Figure 5:
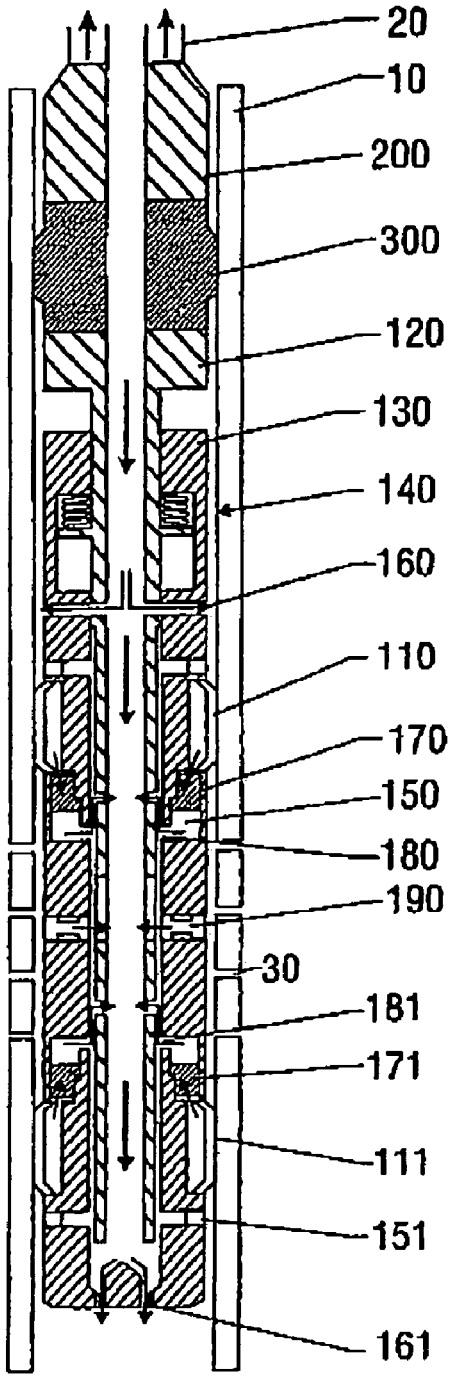
FIG. 5 shows one embodiment of the bottom hole assembly having its dump ports opened and the packing elements being deflated.

As shown in FIG. 5, the inflatable upper and lower packing elements 110 and 111 are each deflated by a direct upward pull on the top of the bottom hole assembly 100 via pulling upward on the coiled tubing 20. The upward pull causes movement between the mandrel 120 and the outer housing 130 of the bottom hole assembly 100, thus opening circulating ports (i.e. top dump port 160 and bottom dump port 161). With these dump ports 160 and 161 open, the packing elements 110 and 111 are deflated as pressure within each packing element is lost. The top dump port 160 and the bottom dump port 161 open to rid of under displaced fracturing slurry directly into the wellbore annulus and out of the bottom hole assembly 100.

Located between the upper packer element 110 and the lower packer element 111 are orifi 190 or fracing port in the outer housing 130 and mandrel 120. The orifi 190 provide fluid communication through the mandrel 120 and the outer housing 130 so that fracing slurry may proceed down the coiled tubing 20, through the mandrel 120, and into the zone to be fraced 30.

To deflate the packing elements 110 and 111, the pressure between the straddle packing elements 110 and 111 is released by pulling upward on the coiled tubing 20. Pulling uppward on the coiled tubing 20 moves the mandrel 120 upward relative to the upper and lower packing elements 110 and 111, and relative to the outer housing 130 of the bottom hole assembly 100.

The embodiment of the bottom hole assembly 100 shown in FIGS. 2–6 includes a timing mechanism 140 to allow the dump ports to remain open long enough so that underdisplaced fluids are flushed from the bottom hole assembly 100. The timing mechanism 140 also prevents the upper and lower packing elements 110 and 111 from resetting before the under-displaced fracturing fluids can be circulated out of the bottom hole assembly. For instance, the timing mechanism 140 may be comprised of a spring 141 within a first upper compartment 142 formed between the outer housing 130 and the shelf 121 on the mandrel 120. A lower compartment 143 is formed between the outer housing 130 and the shelf 121 on the mandrel, below the shelf 121. A hole exists in the shelf 121 to allow hydraulic fluid 145 to pass between the compartments 142 and 143 as mandrel 120 moves axially with respect to outer housing 130. Springs 141 are located within the upper compartment 142 to bias the mandrel 120 in its lower-most position such that the upper dump port and the lower dump port are closed, i.e. the annulus and the flow path within the mandrel 120 are not in fluid communication.

An upward force may be applied to the mandrel 120 to open the upper dump port 160 and lower dump port 161. Ideally, the mandrel 120 will be fully stroked to its upper most position. Once stroked, the timing mechanism 140 begins to urge the mandrel 120 to its original location in which the upper and lower dump ports are closed. With the dump ports closed, the flushing of the bottom hole assembly 100 ceases. Typically, if the mandrel 120 is fully stroked (i.e. taken to its upper most position with respect to outer housing 130), approximately 10 minutes passes before the mandrel 120 returns to its original position closing the dump ports. By changing the parameters of the timing mechanism (i.e. hole in the mandrel 144, size of upper and lower chambers 142 and 143, or changing the spring constant of springs 141), the amount of time the dump ports are open may change. However, in a preferred embodiment, it is desired to flush the bottom hole assembly for ten minutes before closing the dump ports so the timing mechanism 140 operates to keep the dump port open for approximately ten minutes (assuming, of course that the mandrel was fully stroked. If the mandrel 120 were only partially stroked, the ten minutes would be reduced).

The timing mechanism 140 produces a time delay on the resetting of the mandrel 120 to ensure enough circulating time is provided such that all the under-displaced fracturing fluids can be circulated out of the bottom hole assembly 100 to prevent the bottom hole assembly from becoming stuck in the casing 10 should excess sand be present. Further the bottom dump port 161, once opened by the mandrel 120, provides a flow path through the bottom hole assembly and there are a minimum of directional changes for the slurry to navigate. This allows gravity to aide in the flushing and removal of the sand slurry from the bottom hole assembly 100.

It should be mentioned that once an upward force is applied to mandrel 120 and the dump ports 160 and 161 are open, the packing elements 110 and 111 do not instantaneously deflate. If they did, it would not be possible to give the mandrel 120 a full stroke, as it is the packing elements 110 and 111 would deflate and the bottom hole assembly 100 would move within the casing 10. Thus, a delay mechanism 148 is provided to allow the packing elements 110 and 111 to remain set for a short time so that the packing elements 110 and 111 do not instantaneously deflate. This delay mechanism 148 is comprised of the flow restrictor in the port from the piston to the mandrel. The flow restrictor thus prevents the instantaneous deflation of the packing elements upon stoke of the mandrel 120. The delay mechanism 148 preferably is designed such that once the mandrel 120 is fully stroked, enough fluid has passed through the port from the piston to the mandrel to deflate the packing elements 110 and 111.

The materials for the mandrel 120 may be selected to minimize erosion. Typically, the maximum flow rate through the bottom hole assembly 100 is 10 bbl/min. In some embodiments, the inside diameter of the mandrel is one inch. Wear due to erosion may occur due to the high velocities and flow direction of the slurry. Carbourized steel combined with gelled fluids reduces the erosion such that these components can last long enough to complete at least one well, or fractures into ten zones, for example. Further, tungsten carbide may be used upstream of the orifi 190 due to the direction change of the frac slurry through the bottom hole assembly 100.

As shown in FIGS. 2–6, upper packer equalization port 150 and lower packer equalization port 151 act in conjunction with an annular space 125 between the mandrel 120 and the outer housing 130 to provide a bypass from above the upper packing element 110 to below the lower packing element 111. This bypass, which remains open, prevents pressure from moving the entire bottom hole assembly 100 up or down the casing 10 if either packer element 110 or 111 were to leak. Should either of packer element 110 or 111 leak, the forces generated are capable of collapsing or breaking the coiled tubing string 20, thus losing the bottom hole assembly 100. The bypass thus acts to equalize the pressure above the upper packing element 110 and below lower packing element 111 so that large pressure differentials will not develop should a packing element fail.

Figure 6:
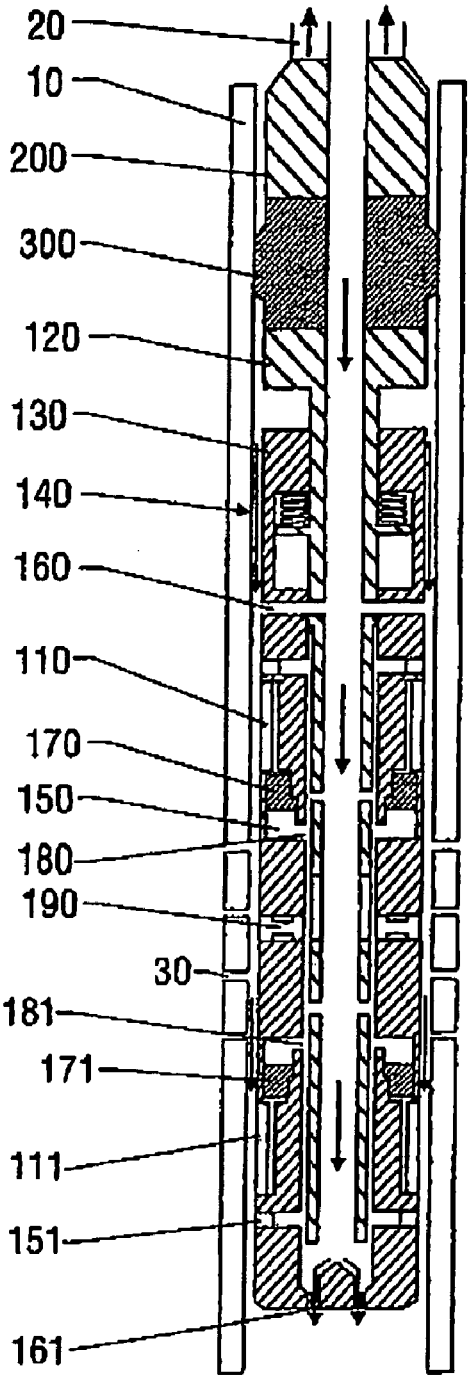
FIG. 6 shows one embodiment of the bottom hole assembly with the mandrel in the up position and the assembly being flushed.

Referring to FIG. 6, the bottom hole assembly 100 is shown in its "up" position (i.e. an upward force is being applied to the mandrel 120 via coiled tubing 20). In this position, bottom hole assembly and the annulus between the bottom hole assembly 100 and the casing 10 may be flushed to remove any sand particles, which may have accumulated during the fracing process. The bottom hole assembly 110 may then be moved to the next zone, the bottom hole assembly 100 set, and the fracing process repeated on the new zone.

Figure 6A:
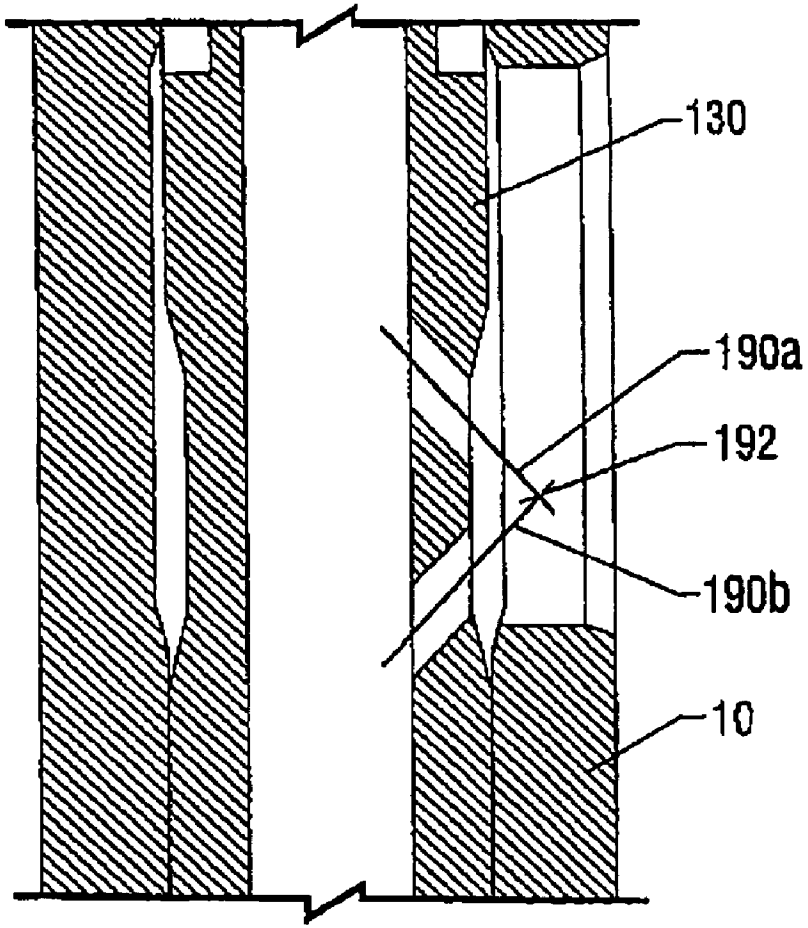
FIG. 6A shows an orifice configuration of one embodiment of the bottom hole assembly.

In some embodiments, the orifi 190 are not located in a single cross sectional plane. As shown in FIG. 6A, orifi 190 may be comprised of two orifi 190*a* and 190*b*. The two orifi 190*a* and 190*b* may form an angle 192. In some embodiments, the angle 192 formed by the two orifi is 90 degrees. In this embodiment, the two orifi 190 are orientated at angle 192 such that the energy in the flow paths exiting the orifi 190*a* and 190*b* will dissipate the energy of the flow of the sand slurry. This eliminates or reduces the erosion of the casing 10 and of the orifice. In other embodiments, one orifice is located between the packers upstream of at lease one flow guide, the flow guide changing the direction of the flow to funnel the slurring into the zone to be fraced 30. The flow guides are typically more robust and resistant to erosion than the orifi.

Referring to FIGS. 7–22, a release tool 200 for the bottom hole assembly is shown. While the release tool 200 is also shown in each of FIGS. 2 and 3–6, the bottom hole assembly 100 disclosed therein does not require the release tool 200. Similarly, the release tool 200 described herein does not require the use of the collar locator 300, the bottom hole assembly 100 described above, or any of the other components of the bottom hole assembly 100 shown in FIGS. 2, and 3–6. Further, the release tool 200 described herein may be utilized with the bottom hole assembly 100 described above, or any other type of bottom hole assembly, such as a bottom hole assembly comprised of any single downhole tool, or any assembly of multiple downhole tools, e.g. The release tool 200 provides additional protection from having any bottom hole assembly from becoming stuck in the casing during any downhole operation, such as a fracing operation.

Thus, in some embodiments, a release tool 200 for attaching any bottom hole assembly to coiled tubing is described. The release tool 200 permits the user to disconnect any bottom hole assembly below the release tool 200 from the coiled tubing 20 in the event the bottom hole assembly becomes stuck in the hole. The release tool allows an operator to try to "jerk" the bottom hole assembly loose from being lodged in casing. This gives the operator a chance to dislodge the bottom hole assembly stuck in the casing, as opposed to simply disconnecting the portion of the bottom hole assembly below the release tool 200 and leaving that portion of the bottom hole assembly in the well bore. The latter is the least preferable action as the bottom hole assembly would then have to be fished out or drilled out before the downhole operation may continue, which increases the time and costs of the operation.

The maximum axial force a string of coiled tubing 20 can withstand, over a given period of time, is generally known by the operator in the field. For example, in some embodiments, the release tool 200 permits the user to pull to this maximum force the coiled tubing 20 string can withstand for short periods of time without completely activating the release tool 200 to release the bottom hole assembly. If the release tool is completely activated, the portions of the bottom hole assembly below the release tool 200 are left stuck in the well.

As mentioned above, because the embodiments disclosed herein may be used in relatively deeper wells, it is not generally possible to determine the exact force necessary to release the bottom hole assembly. And as the bottom hole assembly is run deeper and deeper in the well, the maximum upward force that can be applied to the bottom hole assembly becomes less and less (due to the weight of the coiled tubing run in the hole and the limitations of the maximum force that may be applied to the coiled tubing because of the strength of the coiled tubing). The present release tool 200 overcomes this problem by providing the operator various options when manipulating the bottom hole assembly. For instance, the operator may apply a relatively high impact force for a very short time (e.g. to try to dislodge the bottom hole assembly) without releasing the bottom hole assembly completely. Alternatively, if the operator really wants to completely release the bottom hole assembly from the coiled tubing, but the bottom hole assembly is relatively deep in the well, a relatively low force (which may be all that the coiled tubing can provide in deep areas as described above) may be applied for a relatively long time to release the bottom hole assembly The release tool 200 has a time delay within a reset mechanism to achieve this function. This is advantageous as it gives the user maximum opportunity to get out of the hole, yet still allows for a disconnect if necessary. The release tool 200 also has a warning in the way of a circulating port 280 to warn the user disconnect is imminent. Therefore, to disconnect and leave the bottom hole assembly in the well, the user must pull in a range of predetermined forces for a determined length of time. For example the user may pull 15,000 lbs. over string weight for a period of 30 minutes before releasing the bottom hole assembly. Alternatively, the user may pull 60,000 lbs. over string weight for 5 minutes without disconnecting.

Figure 7:
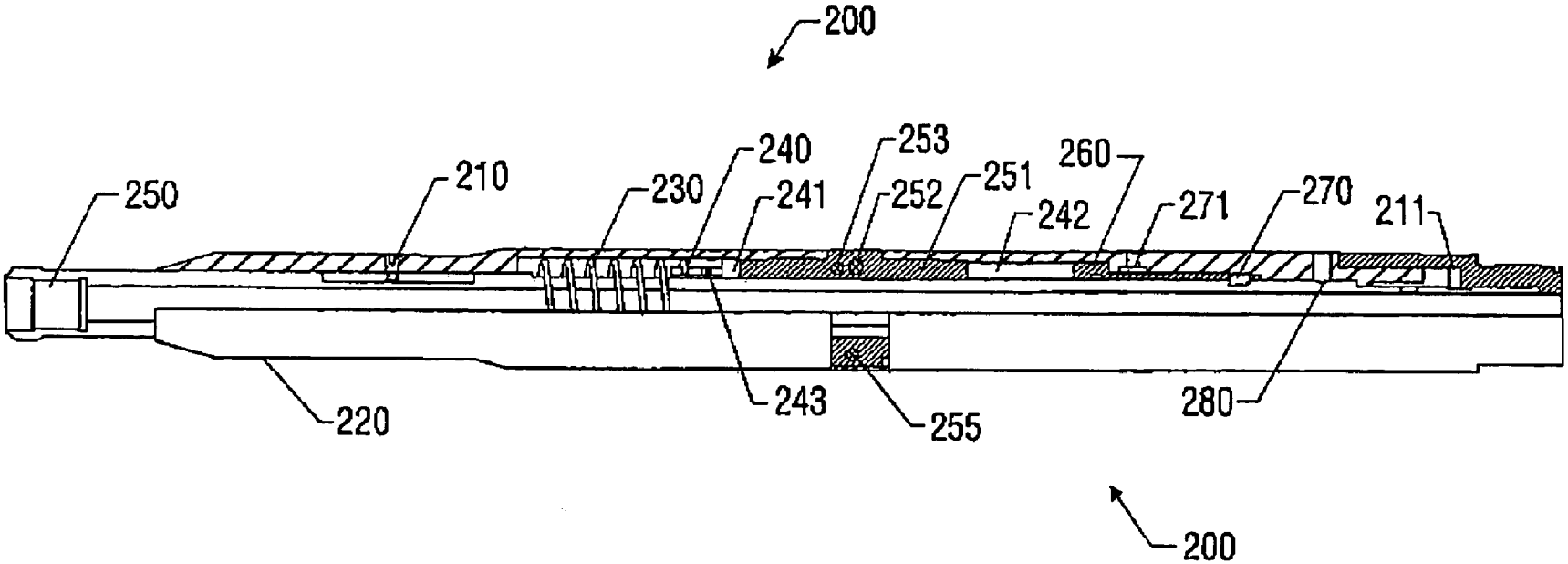
FIG. 7 shows one embodiment of the release tool of a bottom hole assembly.

Referring to FIG. 7, the bottom hole assembly of one embodiment of the present invention is shown having a release tool 200 with a release tool mandrel 250. A fishing neck housing 220 surrounds the release tool mandrel 250, the release tool mandrel 250 being axially movable within the fishing neck housing 220.

The release tool 200 may also include a reset mechanism to allow the operator to apply varying amounts of tension for varying amounts of time (as described hereinafter) to try to jerk the bottom hole assembly out of the casing, should the bottom hole assembly become lodged in the casing. The reset mechanism may include a balance piston 240 contained by the release tool mandrel 250 and the fish neck housing 220. Located below piston 240 and encircling the release tool mandrel 250 is a crossover 251. Below the crossover 251 is lower piston 260, which also circumscribes and is fixedly attached to the release tool mandrel 250, by a key 270. The fishing neck housing 220 has a circulating port 280 on its lower end.

The release tool 200 may allow for a three-stage release. The first stage allows the user to jerk the bottom hole assembly in the casing 10 at various forces for various times without releasing the bottom hole assembly. As the maximum time/tension settings are reached in stage one, a circulating port 280 opens to indicate that the release tool 200 is reaching the end of reversible stage one, such that if additional force is applied, the bottom hole assembly will subsequently be released. If the user does not wish to release the bottom hole assembly, the user may cease applying the upward force (i.e. pulling on the coiled tubing) and the release tool 200 will reset to its original state.

If additional force may be applied, the release tool 200 passes to stage two. In stage two, circulation is still possible. However, the release tool 200 cannot be reset after stage two is initiated as described hereinafter.

Finally, in stage three, the bottom hole assembly is released as the release tool mandrel 250 is completely pulled out of the fishing neck housing 220. The remaining portions of the bottom hole assembly may then have to be removed by other means (e.g. fishing out, drilling, milling, etc.).

Figure 8:
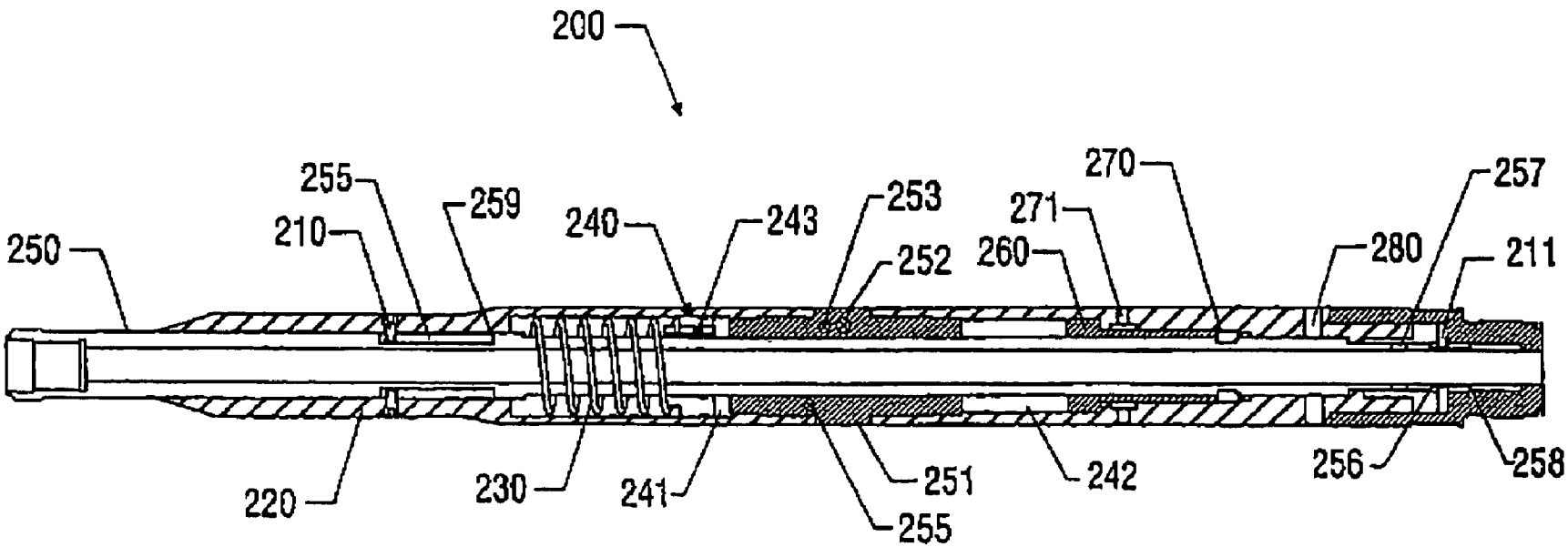
FIG. 8 shows one embodiment of the release tool in the running configuration.

FIG. 8 shows the components of FIG. 7 in greater detail as the bottom hole assembly is run in hole. A closed pressure fluid system (e.g. hydraulic fluid) is shown below the balance piston 240 comprising an upper chamber 241 and a lower chamber 242. The upper chamber 241 is located below (i.e. to the right in FIG. 8) the balance piston 240 and above the crossover 251. The lower chamber 242 is located below the crossover 251 and above lower piston 260. Each of the lower chamber 242 and upper chamber 241 is adapted to be filled with a pressure fluid, such as hydraulic fluid. Fluid communication from the lower chamber 242 to the upper chamber 241 and vice versa is selectively provided through the crossover 251 as described hereinafter.

Within crossover 251 is a pressure relief valve 252 and a flow restrictor 253. Fluid flow from the lower chamber 242 to the upper chamber 241 through the crossover 251 may be controlled via the pressure relief valve 252 and the flow restrictor 253 as described hereinafter. The pressure relief valve 252 may comprise any commercially-available pressure relief valve, such part number PRFA2815420 provided from the Lee Company, and the flow restrictor 253 may comprise a commercially-available flow restrictor such as the Lee-JEVA part number JEVA1825130K. Further, as described more fully hereinafter, balance piston 240 may further comprise a balance piston pressure relief valve 243, such as part number PRFA28122001 also from the Lee Company, in some embodiments.

Similarly, fluid flow from the upper chamber 241 to the lower chamber 242 may be controlled via resetting check valve 255, as described hereinafter. Resetting check valve may be commercially available from the Lee Company, part number CHRA1875505A.

Above balance piston 240 is a biasing means, such as a spring 230, encircling the release tool mandrel 250. The biasing means is adapted to be compressed when the release tool mandrel 250 moves upwardly with respect to the fishing neck housing 220. For instance, in some situations described hereinafter, an upward force on the release tool mandrel 250 also moves the balance piston 240 upwardly (with the release tool mandrel 250) with respect to the fishing neck housing 220, thus compressing spring 230.

Operation of the release tool 200 is now described. To attempt to release a bottom hole assembly (not shown) from coiled tubing that has become stuck in a casing, an operator at surface may apply an upward force on the coiled tubing connected to the release tool mandrel 250. The release tool mandrel 250 is connected to the lower piston 260 via key 270. Thus, the upward tensile force on the release tool mandrel 250 is directly transferred from the release tool mandrel 250 to the lower piston 260. I.e., as long as the key 270 attaches the release tool mandrel 250 and the lower piston 260, the lower piston 260 and the release tool mandrel 250 act as one component. The upward force from the lower piston 260 thus acts on the pressure fluid (e.g. hydraulic fluid) within the lower chamber 242.

Initially, the pressure relief valve 252 is not open and thus prevents flow from the lower chamber 242, through the crossover 251, and into the upper chamber 241. As the upward force on the release tool mandrel 250 and thus on the lower piston 260 increases, the pressure of the fluid within the lower chamber 242 increases. When the pressure of the fluid within the lower chamber 242 reaches a predetermined value, the pressure relief valve 252 opens to allow fluid communication from the lower chamber 242 to the upper chamber 241. In this way, the pressure relief valve 252 determines the upward force required to begin the actuation of the reset mechanism of the release tool 200. Of course, this predetermined pressure value directly corresponds to a given upward force value, as well (pressure equals force divided by the surface area of the balance piston 260 acting on the pressure fluid), all other variables remaining constant. This upward force may be 24,000 lbs. in some embodiments, for example, to initially activate the reset mechanism of the release tool 200.

Once the pressure relief valve 252 opens to initially activate the reset mechanism of the release tool 200, fluid flow from the lower chamber 242 to the upper chamber 241 is allowed, but in a controlled fashion via flow restrictor 253. Continued application of an upward force allows fluid communication from the lower chamber 242 to the upper chamber 241. The flow restrictor 253 operates in a way such that the greater the upward force on the release tool mandrel 250, the faster the fluid flows through the crossover 251, and the faster the release tool mandrel 250 moves upwardly with respect to the fishing neck housing 220. In this way, the release tool 200 is adapted to allow the application of varying amounts of forces for varying amounts of time to allow the user to try to dislodge the bottom hole assembly.

As described above, as the release tool mandrel 250 moves upwardly with respect to the fishing neck housing 220, spring 230 becomes compressed. Thus, the downward force from the spring 230 applied to the pressure fluid in the upper chamber 241 via the balance piston 240 increases as the mandrel 250 moves upwardly with respect to fishing neck housing 220.

If the upward force on the release tool mandrel 250 is lessened sufficiently, then the downward force of the spring 230 acting against the balance piston 240 is greater than the upward force on the mandrel 250, and the pressure fluid within the upper chamber 241 will pass from the upper chamber 241 to return to the lower chamber 242 via resetting check valve 255 in the crossover 251. The resetting check valve 255 operates to control the fluid flow from the upper chamber 241 to the lower chamber 242. If the upward force is removed from the mandrel 250, the downward force applied by the biasing means such as the spring 230 forces fluid from the upper chamber 241 to the lower chamber 242 at a rate determined by the resetting check valve 255. Similarly, if the bottom hole assembly successfully becomes dislodged or free, the upward force of the release mandrel 250 is significantly reduced (i.e. equal only to the weight of the bottom hole assembly being supported by the release tool mandrel 250 bottom hole assembly). The downward force of the spring 230 thus forces fluid from the upper chamber 241 to the lower chamber 242 in a manner controlled by resetting check valve 255.

The various components described may be selected to achieve the desired operation at desired times. For instance, the pressure relief valve 252, the flow restrictor 253, the resetting check valve 255, the surface area of the balance piston 240, the initial volume of the upper chamber 241 and the lower chamber 242, the spring constant of the spring 230, etc. may be selected or designed in combination such that the release tool 200 functions as described herein, as is understood by one of ordinary skill in the art having the benefit of this disclosure.

In the embodiment shown, the balance piston 240 may further comprise a balance piston pressure relief valve 243 (e.g. Lee Component Part Number PRFA2812200L). The biasing means such as the spring 230 above the balance piston 240 operated in an environment of working fluid at well bore pressure. As described above, below the balance piston 240 is upper chamber 241. Balance piston pressure relief valve 243 may act as a safeguard to protect the hydraulic system from overheating. For example, should the pressure of the fluid within the upper chamber 241 and lower chamber 242 become excessive (because of, e.g., excessive downhole temperatures), the second pressure relief valve 243 may open to allow hydraulic fluid to pass from the upper chamber 241 to the area above the balance piston 240, into the working fluid, and into the annulus, thus protecting the hydraulic system from becoming damaged by excessive pressure.

The operation of the release tool 200 will now be further described in conjunction with FIGS. 8–22. FIG. 8 shows the release tool 200 when being run in hole. The release tool has not been "stroked" at all, i.e. the release tool mandrel 250 is in its lower-most position with respect to fishing neck housing 220.

Referring to FIG. 8, after the release tool 200 is run in hole, an upward force may be applied to the release tool mandrel 250 by the operator pulling on the coiled tubing at surface. This upward force is transferred from the coiled tubing 20 to the release tool mandrel 250, from the release tool mandrel 250 to the key 270, from the key 270 to the lower piston 260, and from the lower piston 260 to the fluid in the lower chamber 242. This upward force thus increases the pressure of the fluid within the lower chamber 242. As described above, if the upward force is sufficiently large, e.g. 24,000 lbs., the pressure of the fluid within the lower chamber 242 increases to a level sufficient to crack open relief valve 252 and fluid communication from the lower chamber 242, through crossover 251, to the upper chamber 241, is possible, the rate of fluid flow being controlled by the flow restrictor 253. Therefore, if the upward force on the release tool mandrel 250 is sufficiently large, fluid will flow from the lower chamber 242 to the upper chamber 241 and the mandrel 250 will move upwardly with respect to fishing neck housing 220.

Figure 9:
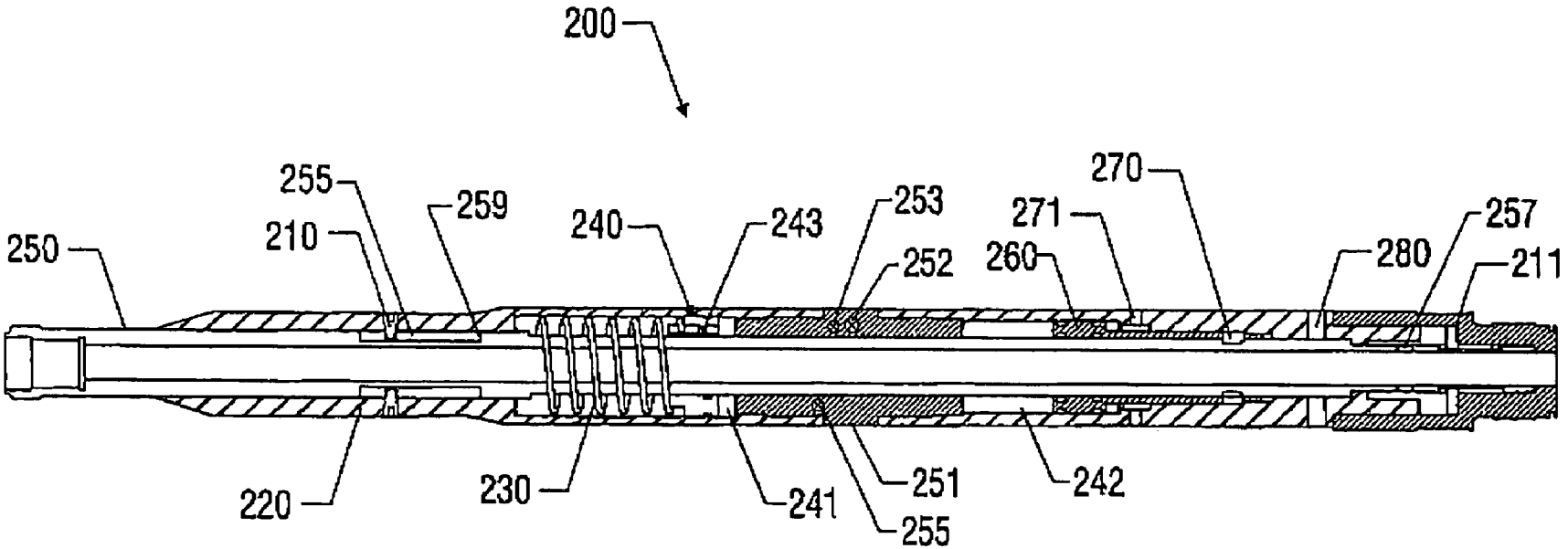
FIG. 9 shows one embodiment of the release tool that is partially stroked.
Figure 10:
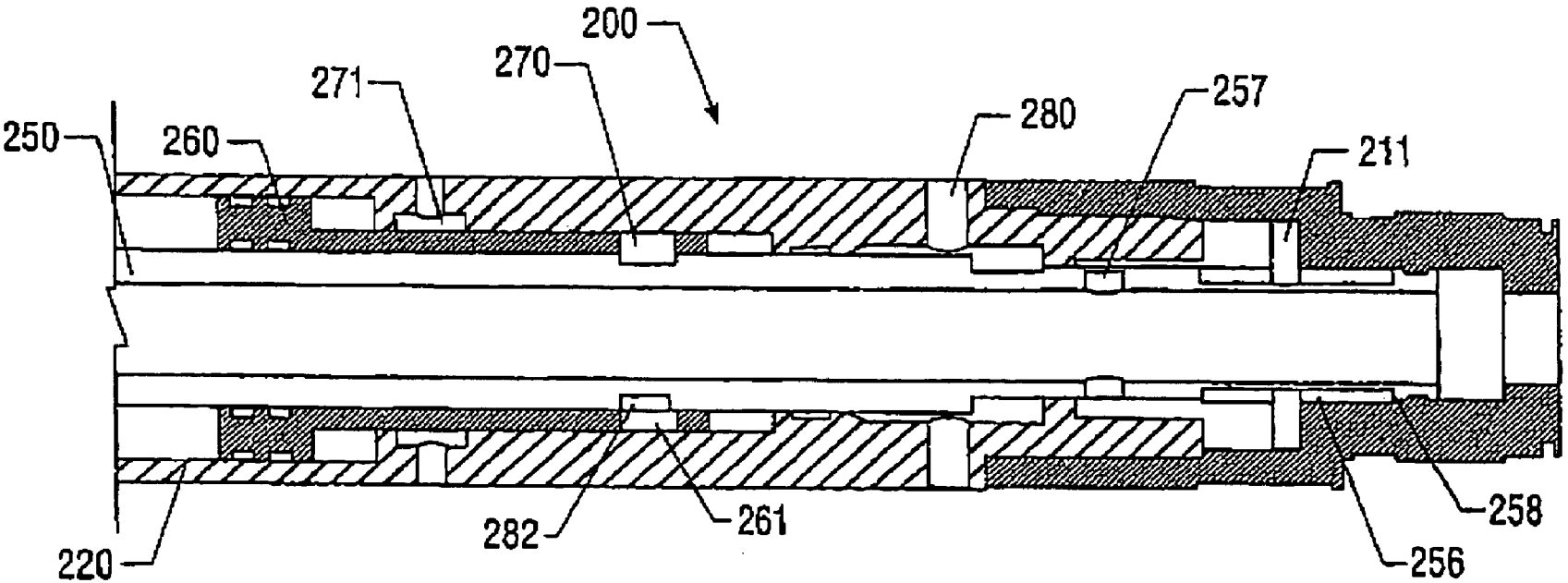
FIG. 10 shows a close up of the lower portion of the release tool of one embodiment of the release tool of FIG. 9.

STAGE ONE. FIGS. 9 and 10 show the release tool 200 during the stage one at a point after the pressure relief valve 252 cracks open to allow fluid communication from the lower chamber 242 to the upper chamber 241, which allows relative movement between the release tool mandrel 250 and the fishing neck housing 220. In FIGS. 9 and 10, the release tool 200 is approximately 20% stroked. As shown, the release tool mandrel 250 has moved upwardly with respect to fishing neck housing 220 as a result of an operator on the surface pulling the coiled tubing 20 (not shown) out of the hole.

Figure 11:
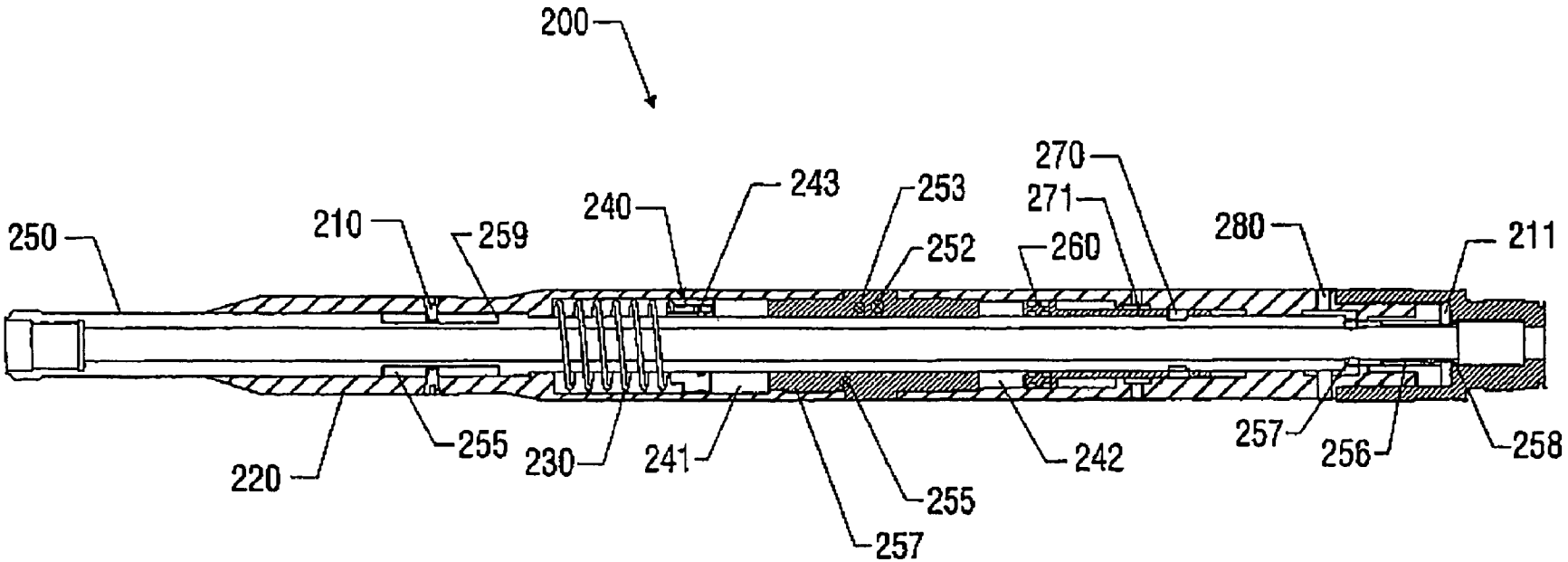
FIG. 11 shows the release tool of one embodiment of the bottom hole assembly being approximately 50% stroked with the circulation ports open and the lower shear pins contacting the lower shoulder of the mandrel.

As shown in FIG. 11, release tool mandrel 250 is provided with lower slots 256, having lower shoulders 258, to accommodate lower shear pins 211. The lower shear pins 211 may be located on the bottom hole assembly, or on the fishing neck housing 220. The shear pins 211 may be screwed through the fishing neck housing 220 to engage slots 256 in the mandrel 250. As the release tool mandrel 250 moves with respect to fishing neck housing 220, the slots 256 move with respect to the lower shear pins 211. At the end of the stroke, the slots 256 end at a lower shoulder 258. The shear pins 211 engage this lower shoulder 258 and subsequently shear as described hereinafter.

Figure 12:
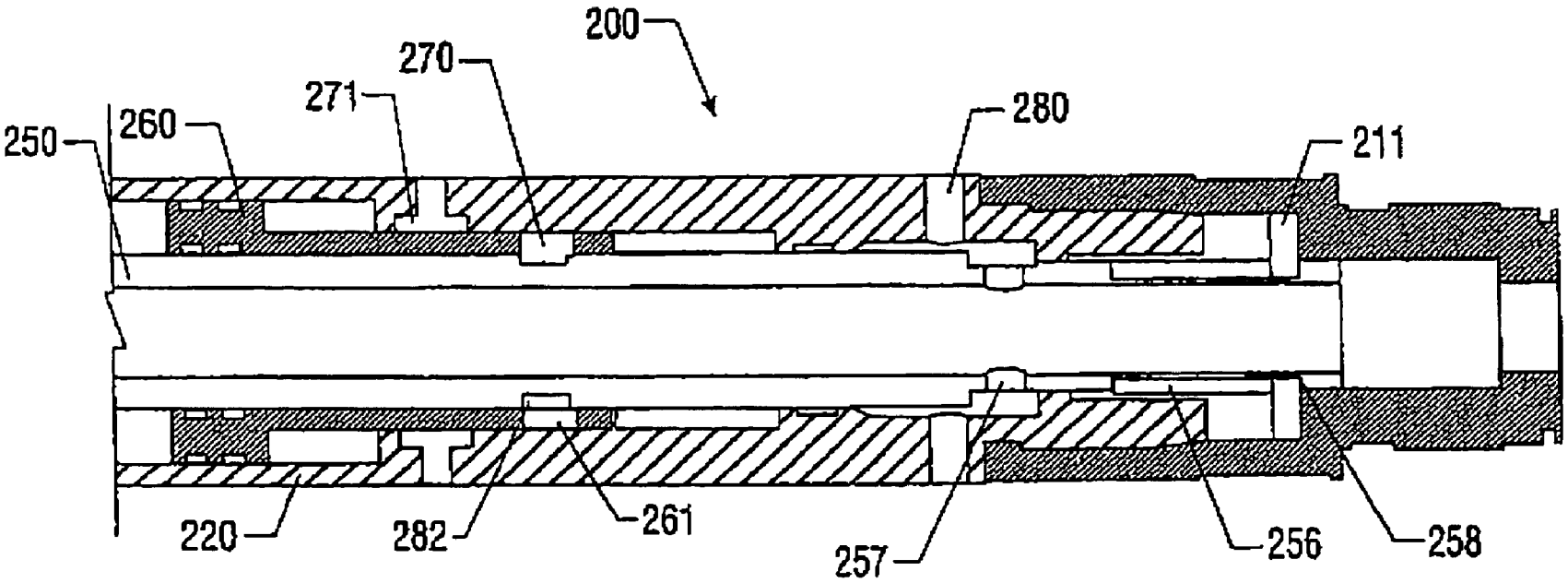
FIG. 12 shows a detailed view of the release tool of FIG. 11.

FIGS. 11 and 12 show the release tool 200 at the end of stage one and prior to entry of stage two. The release tool mandrel 250 is shown having traveled up hole, e.g. two inches, until the lower shear pins 211 of the fishing neck housing 220 engage the lower shoulders 258 of the lower slots 256 on the release tool mandrel 250 Typically, in some embodiments, this takes about ten minutes to go two inches stroke at 26,000 pounds pull or upward force over string weight (i.e. in excess of the weight of the string of coiled tubing extending from surface). Alternatively, it may take about three minutes at 80,000 lbs. pull or upward force over string weight. In this way, varying amount of forces for varying amounts of time may be applied during stage one to assist the operator in dislodging the bottom hole assembly.

As shown in FIGS. 11 and 12, at this point the circulation ports 280 in the fishing neck housing 220 are aligned with the fluid communication ports 257 in the release tool mandrel 250 such that fluid communication is provided from the casing, through the ports 280 and 257, and into the release tool mandrel 250. As shown, the circulation ports 280 and 257 are open to let the operator at surface know that the release tool 200 is mid-stroke of stage one, after which point the bottom hole assembly will have to be released. I.e. once stage two is initiated, the release tool 200 can no longer be reset. Fluid communication begins at mid-stroke, e.g. 1" stroke of travel. Therefore, the operator at surface may sense that the release tool 200 has be stroked at mid-stroke; fluid communication may continue through full stroke (e.g. 2" of travel). As shown in FIGS. 11 and 12, the predetermined force/time combination has been applied to the release tool 200, such that the lower shear pins 211 are against the lower shoulders 258 of the release tool mandrel 250, but have not been sheared. As long as the lower shear pins have not been sheared, the release tool 200 remains in stage one; therefore, the spring 230 will return the release tool 200 to its original state once the upward force on the release tool mandrel 250 is removed.

Figure 13:
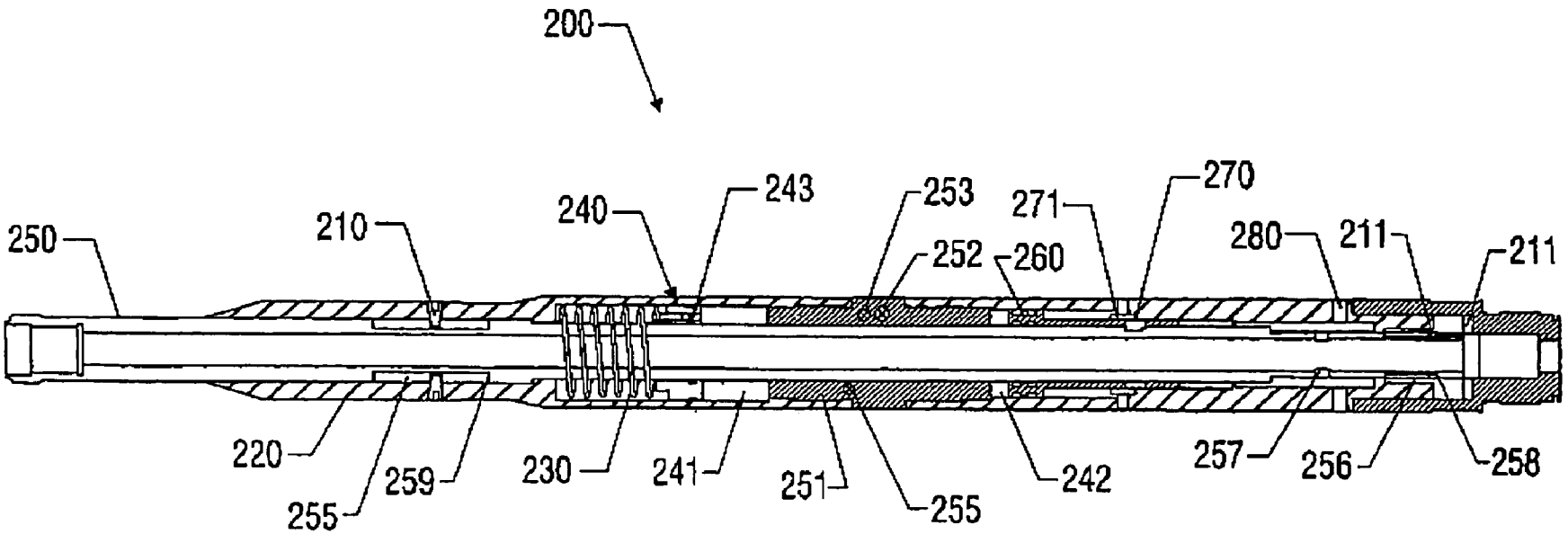
FIG. 13 shows the release tool of one embodiment of the bottom hole assembly being approximately 85% stroked with the circulation port open and the shear pins sheared.
Figure 14:
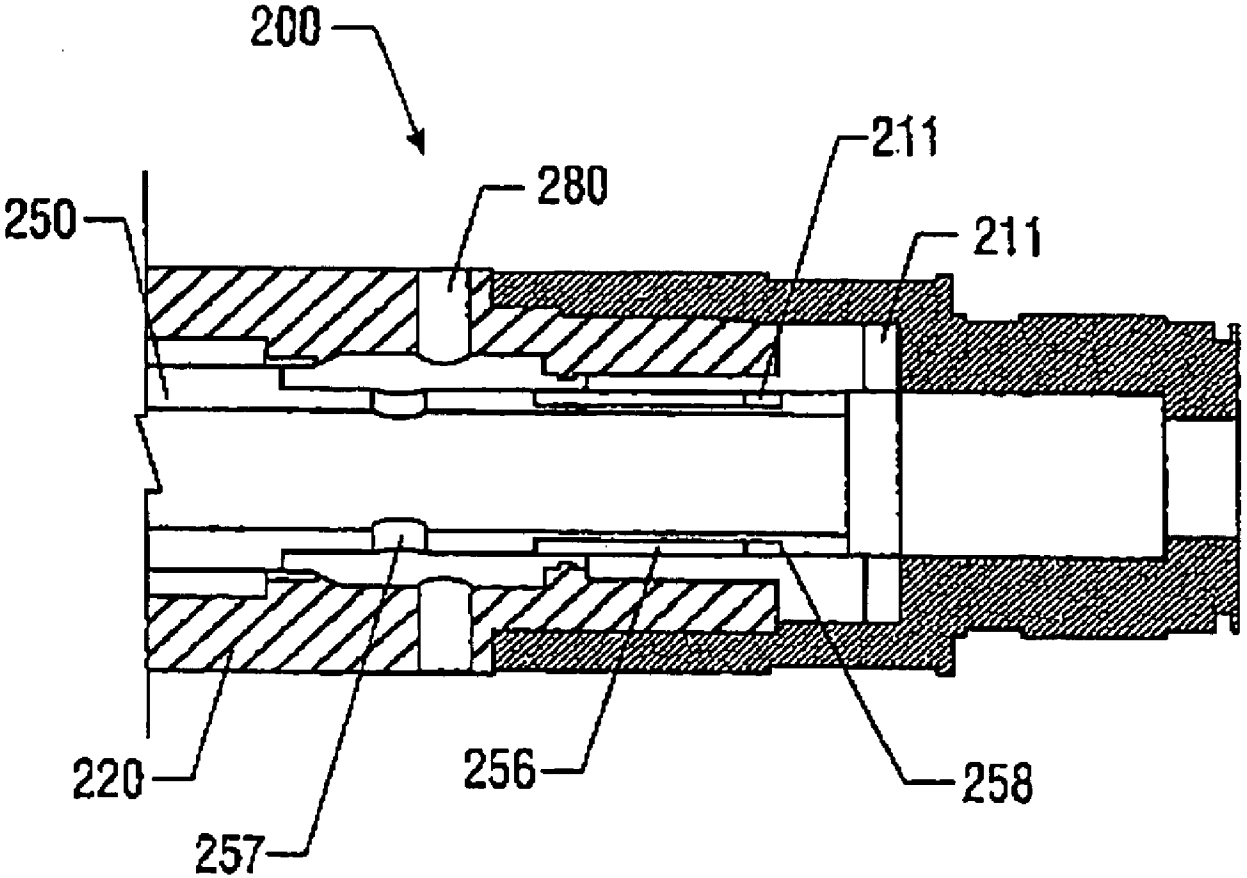
FIG. 14 shows a detailed view of the lower section of the release tool of FIG. 13 with the lower pins sheared.
Figure 15:
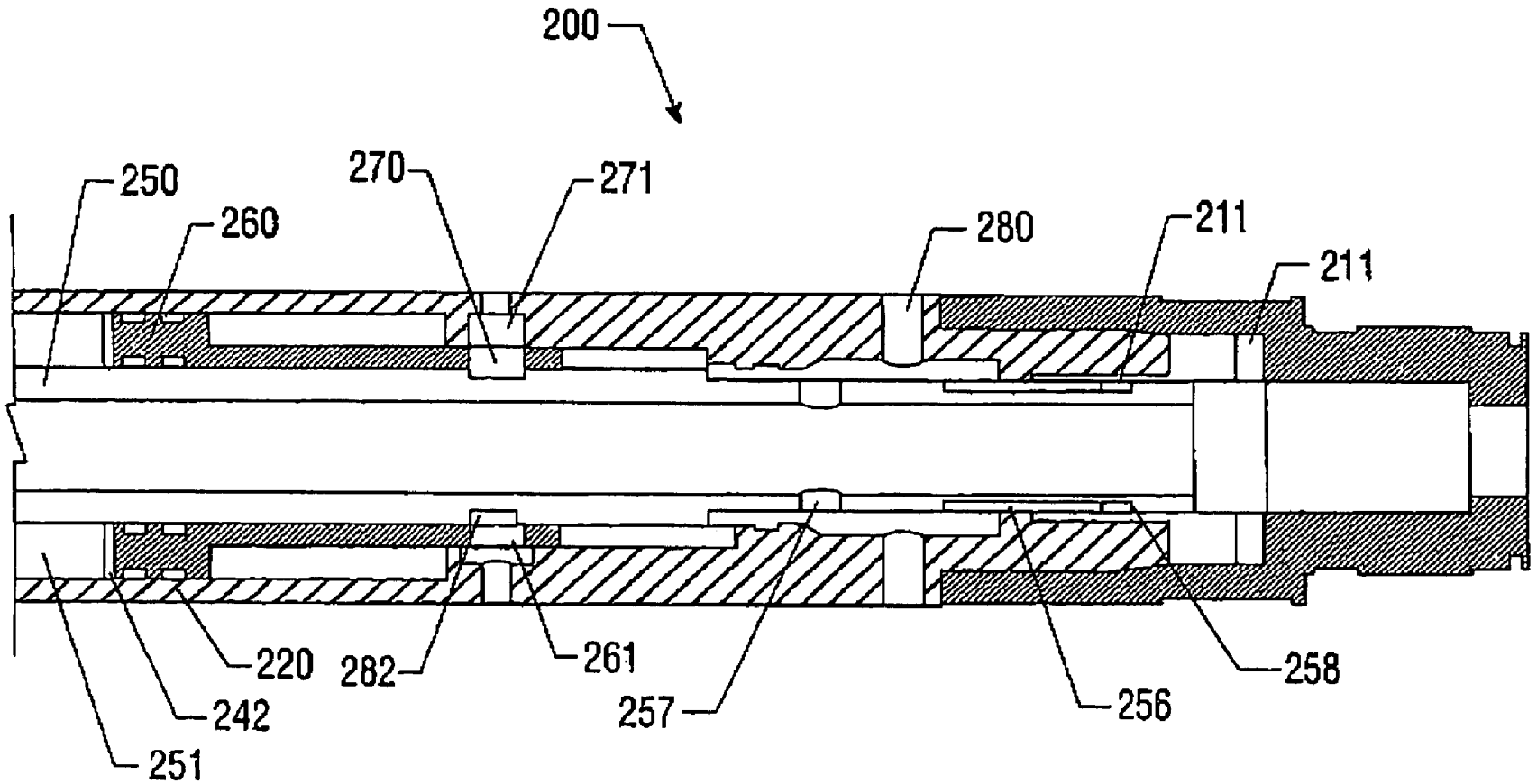
FIG. 15 shows a detailed view of the lower section of the release tool of FIG. 13.

STAGE 2. Referring to FIGS. 13, 14, and 15, stage two of the release process has been initiated. With an increased upward force, lower shear pins 211 contact and are sheared by the shoulders 258 of the lower slots 256. This upward force required to shear the lower shear pins 211 may be any predetermined value, at, e.g., 32,000 lbs. pull.

As shown in FIG. 13, the release tool mandrel 250 is provided with upper slots 255 to accommodate the upper shear pins 210 of the fishing neck housing 220. Upper slots 255 are provided with shoulders 259. Once the lower shear pins 211 have been sheared, the release tool mandrel 250 continues upwardly, e.g. 1.6" in this embodiment, until upper shear pins 210 engage the shoulders 259 in the upper slots 255 of the release tool mandrel 250.

As shown in FIG. 15, key 270 connects the lower piston 260 to the release tool mandrel 250 by fitting in balance piston slot 261 and mandrel groove 282. The key 270 may be biased outwardly by a spring, for example. When the upper shear pins 270 engage shoulders 259 in upper slots 255, the key 270 in lower piston 261 slot and the release tool mandrel groove 282 aligns with the slot 271 in fishing neck housing 220. As the key 270 moves out of the groove 282 in the release tool mandrel 250 and into the slot 271 in the fishing neck housing 220, the key 270 being biased outwardly, the release tool mandrel 250 is released from the lower piston 260 and the fishing neck housing 220. In this way, the key 270 may selectively connect the lower piston 260 and the release tool mandrel 250.

Figure 16:
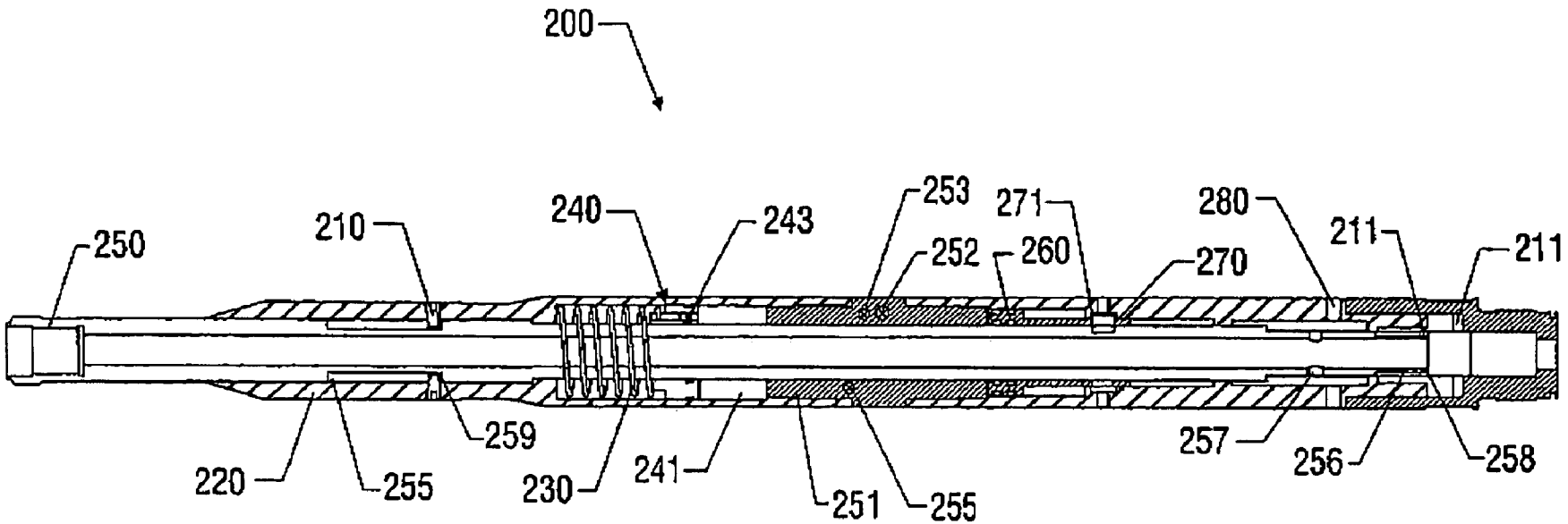
FIG. 16 shows the release tool of one embodiment of the bottom hole assembly with the key driven out of the mandrel and into the slot in the fishing neck housing.
Figure 17:
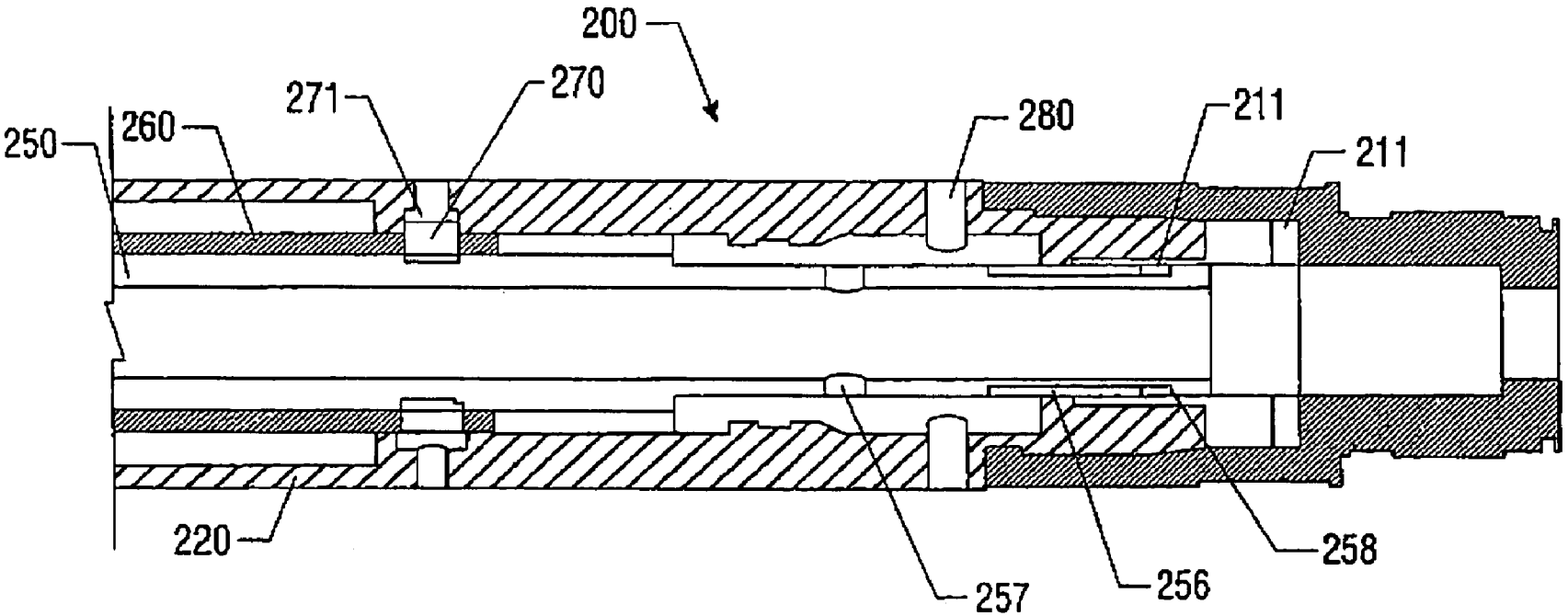
FIG. 17 shows a detailed view of the lower section of the release tool of FIG. 16.

FIG. 15 shows key 270 aligning with slot 271 but prior to the key 270 entering the slot 271 to release the release tool mandrel 250. FIGS. 16 and 17 show the key 270 out of the groove 282 in the release tool mandrel 250 and into slot 271 in the fishing neck housing 220. As can be seen, the circulating ports 280 and 257 remain open or in alignment. Again, once stage two is initiated and the lower shear pins 211 are sheared, the release tool 220 may no longer be reset.

Figure 18:
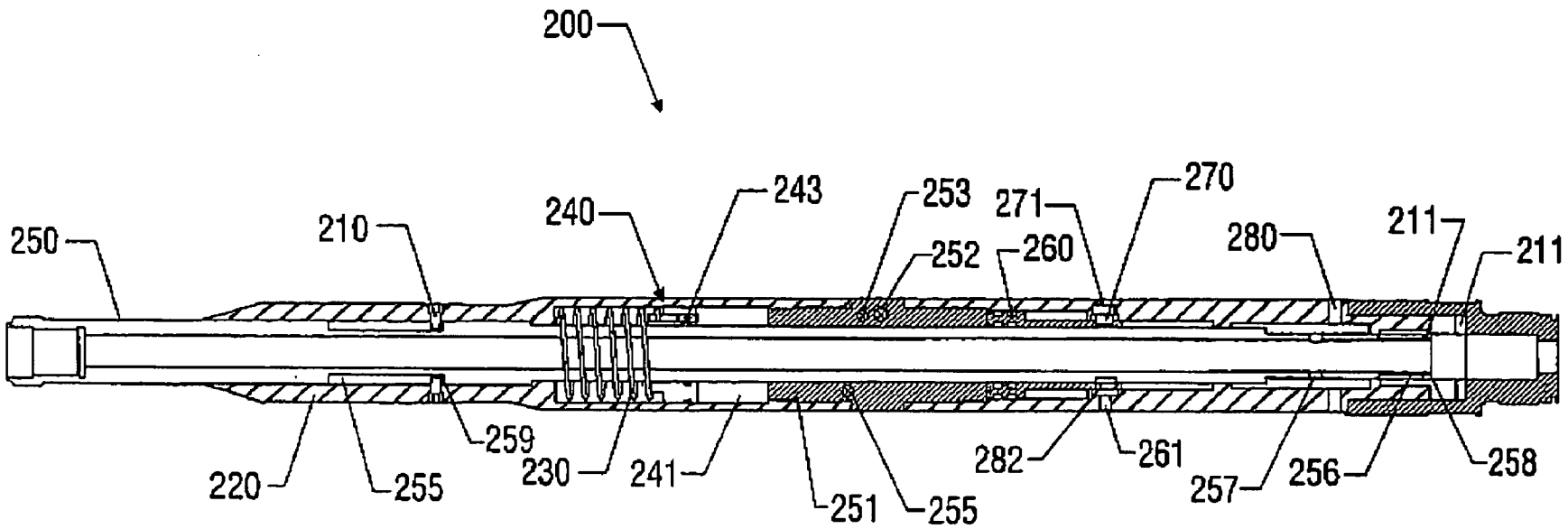
FIG. 18 shows the release tool of one embodiment of the bottom hole assembly being completely stroked with the circulating ports open and the lower shear pins sheared.
Figure 19:
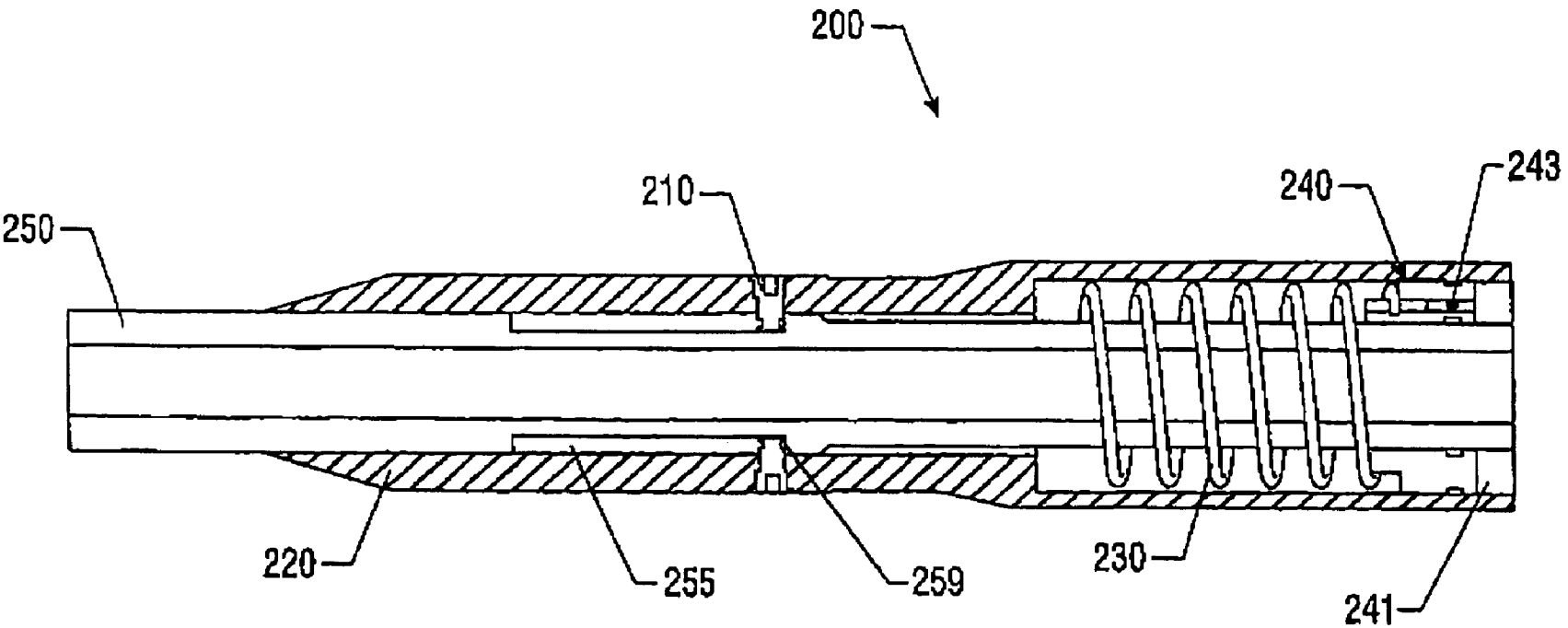
FIG. 19 shows the release tool of one embodiment of the bottom hole assembly at a final safety position with upper pins contacting the upper shoulder on the mandrel.
Figure 20:
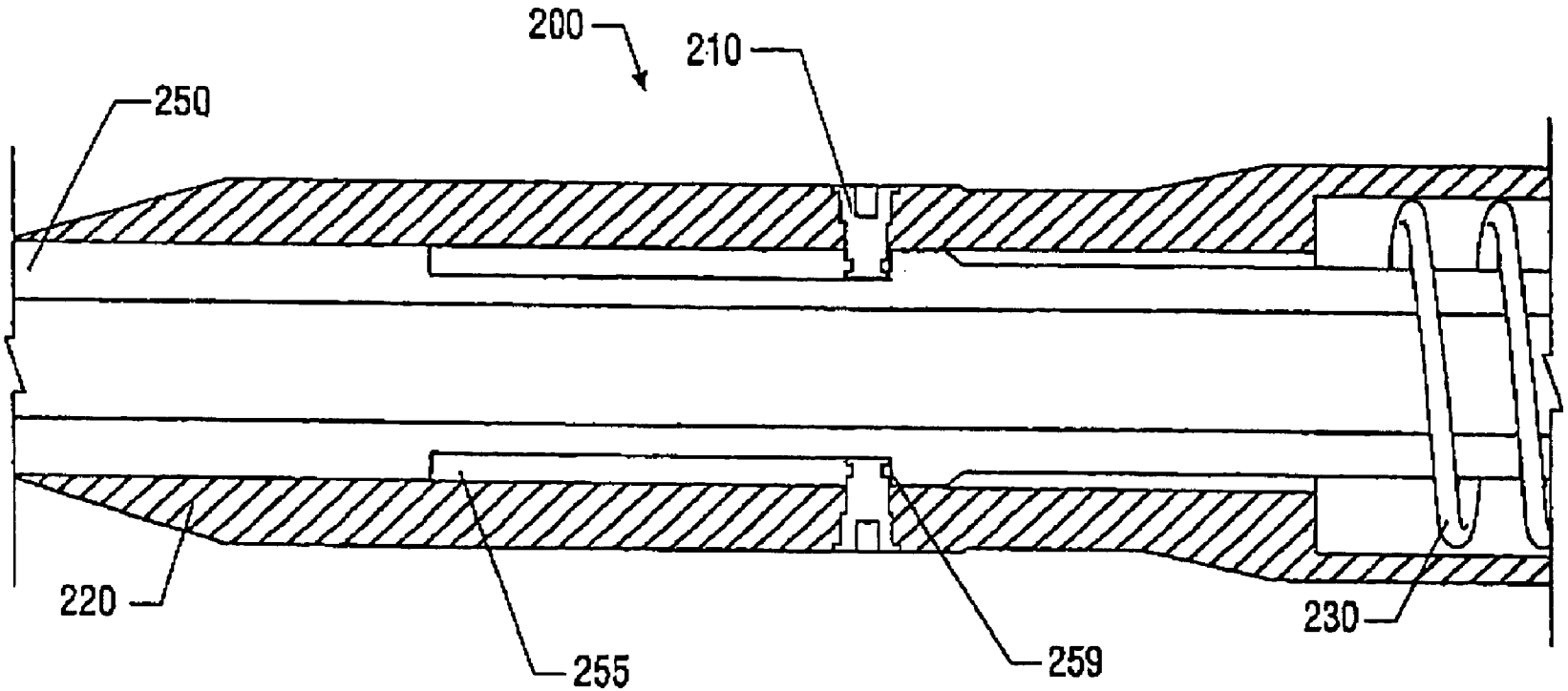
FIG. 20 shows a detailed view of the upper shoulder section of the mandrel of the release tool of FIG. 19.
Figure 21:
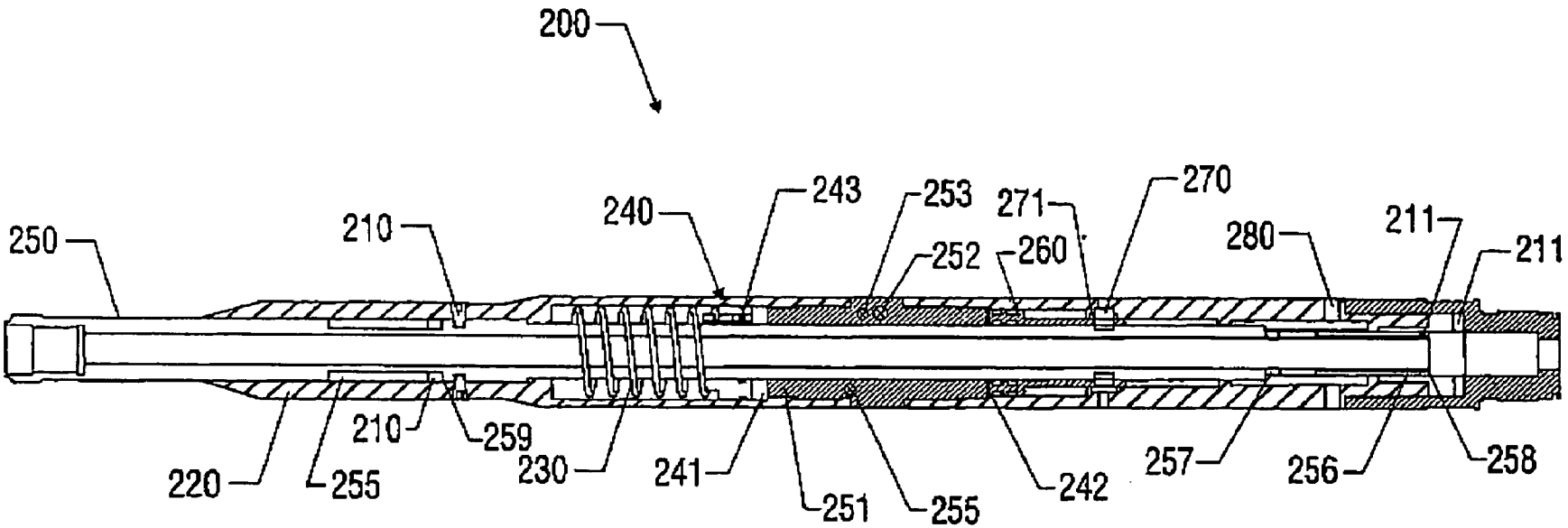
FIG. 21 shows the release tool of one embodiment of the bottom hole assembly with the release tool completely released.
Figure 22:
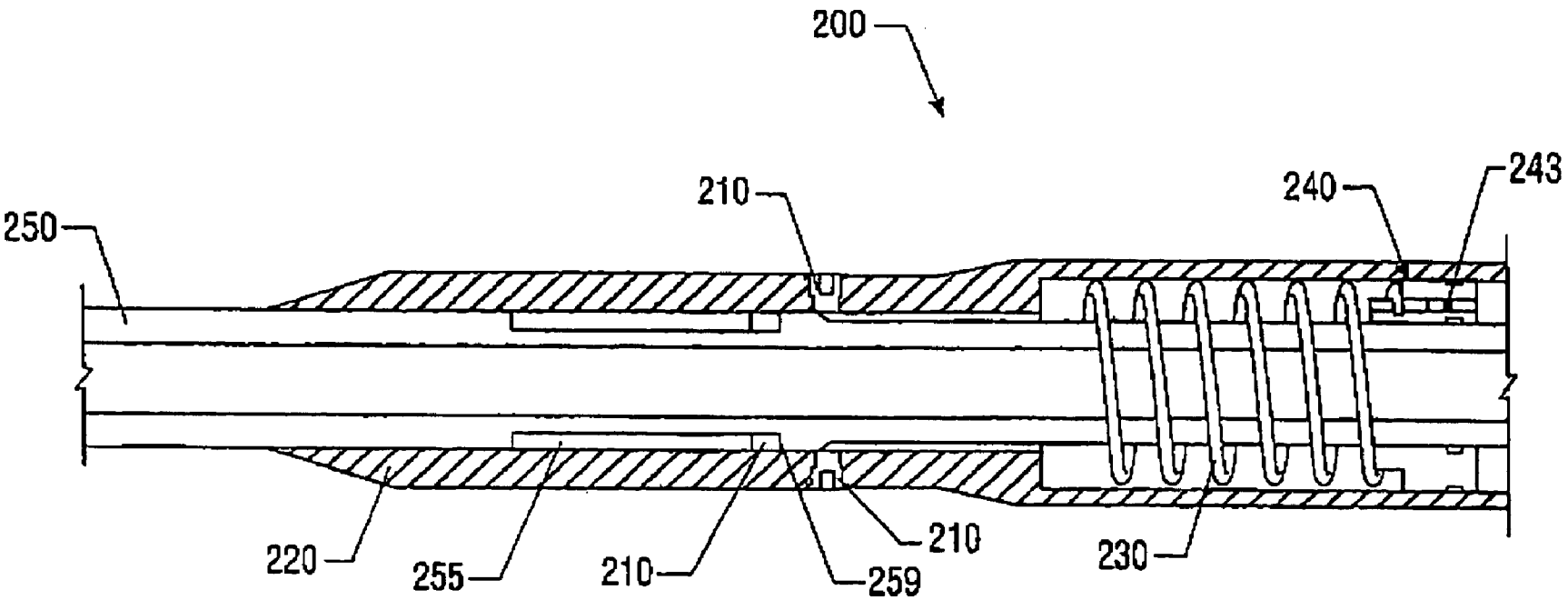
FIG. 22 shows a detailed view of FIG. 21.

STAGE THREE. With the application of a second or additional force, the release tool 200 moves to stage three. FIGS. 18–20 show the release tool 100% stroked just prior to release. The upper shear pins 210 are about to be sheared by the shoulders 259 of upper slots 255 of the release tool mandrel 250. As shown in FIG. 21, the upper shear pins 210 are sheared by the shoulders 259 of upper slots 255 at a predetermined force, e.g. 32,000-pounds pull, or greater. 32,000 lbs. may be sufficient to shear the lower shear pins 211 and then upper shear pins 210 consecutively. Therefore, if a 32,000-pound load were applied, lower shear pins 211 shear, and the upper shear pins 210 would contact the shoulder 259 and also subsequently shear. Alternatively, the upper shear pins 210 may be designed to be sheared by the shoulders 259 of upper slots 255 at a predetermine force higher than 32,000 lbs., such as 38,000 lbs. for example. The release tool mandrel 250 then pulls out of fishing neck housing 220 leaving the remainder of the bottom hole assembly including the bottom hole assembly and the fishing neck housing in the well. The coiled tubing 20 is not open-ended and thus cannot be reattached to the tool. FIGS. 21 and 22 show the release tool 200 completely released.

Figure 23:
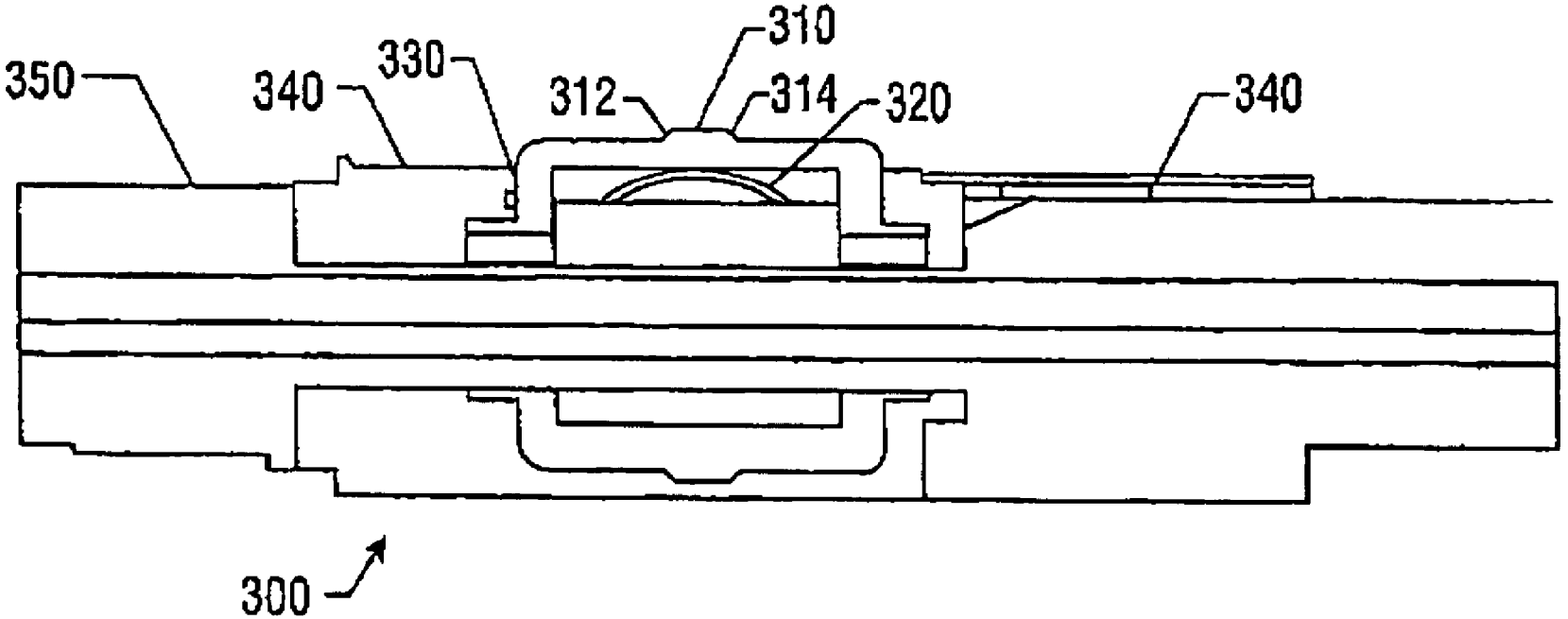
FIG. 23 shows one embodiment of a collar locator for use with embodiments of the bottom hole assemblies described herein.

Referring now to FIG. 23, a collar locator 300 for the bottom hole assembly is shown. Although shown in each of FIGS. 2–6, the mechanical collar locator may or may not be used in conjunction with the bottom hole assembly described therewith. Similarly, the mechanical collar locator 300 may or may not be used in conjunction with the release tool 200 described herein.

The mechanical collar locator 300 is designed to function in a sand/fluid environment. The collar locator 300 may be used to accurately position the bottom hole assembly at a depth in the well bore by referencing the collars that are in the casing 10.

The collar locator 300 may circumscribe a collar locator mandrel 350. The keys 310 are biased by the spring 320 in a radially outward-most position. The keys 310 are displaced inwardly in the radial direction from this position as dictated by the inner diameter of the casing 10. The keys are kept movably in place around mandrel 120 by the key retainer 340.

As the collar locator 300 travels through the casing 10, the key 310 contacts the casing 10 and the collars therein. When the key 310 encounters a collar in the casing 10, the key 310 travels outwardly in the radial direction. To enter the next joint of casing, the key 310 must travel inwardly again, against the force of the spring 320. The upset located in the center of the key 310 has a trailing edge 312. The angle of the leading edge 314 has been chosen such that the resulting axial force is sufficient to be detected at surface by the coiled tubing operator when run into the hole.

The leading edge 314 angle for running in the hole is different than the trailing edge 312 for pulling out of the hole. Running in the hole yields axial loads of 100 lbs., and when pulling out of the hole the axial load is 1500 lbs.

The upset also has an angle on the trailing edge 312 that has been chosen such that the resulting axial force is sufficient to be detected at surface by the coil tubing operator when pulling out of the hole.

The collar locator 300 may withstand sandy fluids. The seal 330 prevents or reduced sand from entering the key cavity around the spring 320. The filter and port 340 allow fluid to enter and exhaust due to the volume change when the keys 310 travel in the radial direction.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A release tool to attach wiled tubing to a bottom hole assembly in a well bore, comprising:

a fishing neck housing functionally associated with the bottom hole assembly;

a release tool mandrel attached to the coiled tubing and adapted to move axially with respect to the fishing neck housing upon the application of an upward force on the coiled tubing; and a reset mechanism, the reset mechanism functionally associating the fishing neck housing and the release tool mandrel such that a predetermined combination of a first upward force may be applied for a corresponding first amount of time to the release tool mandrel without releasing the bottom hole assembly, and such that the after the application of the predetermined combination of the first upward force for the first amount of time, the application of a second upward force wilt release the bottom hole assembly from the coiled tubing, the reset mechanism having a a first chamber, a second chamber, and a biasing means adapted to apply a biasing force, wherein a pressure fluid is adapted to flow from the second chamber to the first chamber after the first predetermined upward force is applied by the coiled tubing, the biasing means adapted to move the release tool mandrel downwardly within the fishing neck housing to reset the release tool when the upward force is reduced below a downward force of the biasing means, wherein the biasing means moves the mandrel downwardly within the fishing neck housing when the upward force is reduced below the force of the biasing means, the downward force from the biasing means forcing pressure fluid from the first chamber to the second chamber, in which rate the pressure fluid flows from the first chamber to the second chamber is controlled by a resetting check valve.

2. The release tool of claim 1 wherein the predetermined combination of first upward force applied for the first amount of time may vary between a small force applied for a longer period of time and a larger force applied for a shorter period of time.

3. The release tool of claim 1 wherein the predetermined combination of first upward force for the corresponding first amount of time ranges from the application of up to about 26,000 lbs. upward force over sting weight for up to about 10 minutes and to the application of up to about 80,000 lbs. over string weight for up to about 3 minutes.

4. The release tool of claim 3 wherein the second upward force is about 32,000 lbs. over string weight and is applied after the predetermined combination of up to about 26,000 lbs. upward force over string weight has been applied for about 10 minutes.

5. The release tool of claim 1 wherein the first chamber is above a crossover and below a balance piston attached to the release tool mandrel.

6. The release tool of claim 1 in which the second chamber is below the crossover and above a second piston attached to the release tool mandrel by a key.

7. The release tool of claim 6 wherein the upward force applied by the coiled tubing to the release tool mandrel causes the second piston to move upwardly to increase the pressure of the pressure fluid in the second chamber.

8. The release tool of claim 7 wherein the rate the pressure fluid flows from the second chamber to the first chamber is controlled by a flow restrictor.

9. The release tool of claim 8 wherein the pressure fluid is hydraulic fluid.

10. The release tool of claim 1 wherein the predetermined combination of first upward force for the corresponding first amount of time includes the combination of the application of approximately up to 15,000 lbs. upward force over string weight for up to about 30 minutes and the predetermined combination of up to about 60,000 lbs. over string weigh for up to about 5 minutes.

11. The release tool of claim 10 further comprising a balance piston pressure relief valve to provide fluid communication out of the first chamber and into the well bore.

12. The release tool of claim 1 wherein the biasing means comprises a spring.

13. The release tool of claim 12 wherein the biasing means is connected to the release tool mandrel via balance piston.

14. The release tool of claim 1 wherein the initial upward force to initially activate the reset mechanism is about 24,000 lbs. over string weight.

15. The release tool of claim 14 further comprising a shear pin movably connecting the fishing neck housing to a slot in the release tool mandrel.

16. The release tool of claim 1 further comprising a collar locator adapted to detect collars in a casing of a well bore, the collar locator comprising:

a collar locator mandrel attached to the coiled tubing and the release tool;

a key mounted within a key retainer and about the mandrel; and a spring, the spring being located between the mandrel and the key to urge the key into contact with the casing.

17. A release tool to attach coiled tubing to a bottom hole assembly in a well bore, comprising:

a fishing neck housing functionally associated with the bottom hole assembly;

a release tool mandrel attached to the coiled tubing and adapted to move axially wit respect to the fishing neck housing upon the application of an upward force on the coiled tubing; and a reset mechanism, the reset mechanism functionally associating the fishing neck housing and the release tool mandrel such that a predetermined combination of a first upward force may be applied for a corresponding first amount of time to the release tool mandrel without releasing the bottom hole assembly, and such that the after the application of the predetermined combination of the first upward force for the first amount of time, the application of a second upward force will release the bottom bole assembly from the coiled tubing, the reset mechanism having a first chamber, a second chamber, and a biasing means adapted to apply a biasing force, wherein a pressure fluid is adapted to flow from the second chamber to the first chamber after the first predetermined upward force is applied by the coiled tubing, the biasing means adapted to move the release tool mandrel downwardly within the fishing neck housing to reset the release tool when the upward force is reduced below a downward force of the biasing means; and a shear pin movably connecting the fishing neck housing to a slot in the release tool mandrel.

18. The release tool of claim 15 or 17 wherein the shear pin is sheared by a shoulder on the slot of the release tool mandrel when the second upward force is applied to the coiled tubing, the second upward force being applied after the predetermined combination of first upward forces and corresponding first amounts of time have been applied.

19. The release tool of claim 18 further comprising:

a circulating port in the fishing neck housing; and a fluid communication port in the release tool mandrel, the circulating port and the fluid communication port adapted to align as the shear pin contacts the shoulder on the slot to provide fluid communication from the well bore, through the circulating port and the fluid communication port, through the release tool mandrel, to surface.

20. The release tool of claim 19 in which the second predetermined upward force is about 32,000 lbs. over string weight.

21. The release tool of claim 18 further comprising a second shear pin movably connecting the coiled tubing to the release tool via a second slot in the release tool mandrel.

22. The release tool of claim 21 wherein the second shear pin is sheared by a shoulder on the second slot of the release tool mandrel when a third predetermined upward force is applied to the coiled tubing, afier the second predetermined upward force has been applied.

23. The release tool of claim 22 wherein the third predetermined upward force is about 38,000 lbs. over string weight.

24. A release tool to attach coiled tubing to a bottom hole assembly in a well bore, comprising:

a fishing neck housing functionally associated with the bottom hole assembly;

a release tool mandrel attached to the coiled tubing and adapted to move axially with respect to the fishing neck housing upon the application of an upward force on the coiled tubing; and a reset mechanism, the reset mechanism functionally associating the fishing neck housing and the release tool mandrel such that a predetermined combination of a first upward force may be applied for a corresponding first amount of time to the release tool mandrel without releasing the bottom hole assembly, and such that the after the application of the predetermined combination of the first upward force for the first amount of time, the application of a second upward force will release the bottom hole assembly from the coiled tubing,;

a collar locator adapted to detect collars in a casing of a well bore, the collar locator having a collar locator mandrel attached to the coiled tubing and the release tool;

a key mounted within a key retainer and about the mandrel; and a spring, the spring being located between the mandrel and the key to urge the key into contact with the casing, and a filter in a port to allow the key to move radially when encountering a collar in the casing.

25. The release tool of claim 24 further comprising a seal adapted to allow the collar locator to be utilized during a fracing procedure.

26. The release tool of claim 25 in which the key has a leading edge at a first angle and a trailing edge at a second angle, the first angle being such that a resulting axial force may be detected at surface by a wiled tubing operator when inserting the release tool into the hole, the second angle being such that a resulting axial force may be detected at surface by the coiled tubing operator when removing the release tool from the well bore.

27. A release tool for usc with coiled tubing to connect a bottom hole assembly with the coiled tubing, the release tool comprising:

a release tool mandrel functionally associated with a fishing neck housing; and a reset mechanism allowing a user to apply varying combinations of a first upward force for a first predetermined length of time to the wiled tubing without releasing the bottom hole assembly from the coiled tubing, the reset mechanism also allowing the user to apply a second predetermined upward force to the release tool via the coiled tubing after the application of the varying combinations of the first upward force for the first predetermined length of time, to release the bottom hole assembly from the coiled tubing, in which the reset mechanism further comprises:

a biasing means;

a balance piston attached to the release tool mandrel;

an upper chamber below the balance piston and above a crossover; and a lower chamber below the crossover above a lower piston, the biasing means adapted to bias the mandrel in a lower-most position within the fishing neck housing to oppose the upward force applied via the coiled tubing, the crossover having a pressure release valve and a flow restricter, the upper and lower chambers having hydraulic fluid, the pressure release valve preventing fluid communication between the upper and lower chambers until a first predetermined upward force is applied to the release tool via the coiled tubing, the flow restricter adapted tocontrol fluid communication from the lower chamber to the upper chamber after the first predetermined upward force is applied to the release tool via the coiled tubing; and a shear pin movably connecting the bottom hole assembly to a slot in the release tool mandrel, the shear pin adapted to connect the release tool mandrel to the fishing neck housing until a second predetermined force is applied via the coiled tubing to shear the shear pins.

28. The release tool of claim 27 in which the first predetermined force is about 24,000 pounds pull over string weight.

29. The release tool of claim 27 in which the second predetermined force is about 32,000 pounds pullover string weight.

30. The release tool of claim 29 further comprising circulation port in the fishing neck housing, the circulation port providing fluid communication between the well bore and a fluid communication port within the release tool mandrel when the lower shear pins contact the fishing neck housing, the fluid communication detectable by a user at surface.

31. The release tool of claim 30 further comprising a key within a lower piston on the release tool mandrel, the key aligning with a slot in the fishing neck housing to release the release tool mandrel.

32. The release tool of claim 31 further comprising a second shear pin moveably connecting the fishing neck housing to a second slot in the release tool mandrel to prevent the bottom hole assembly from being completely released from the coiled tubing until a third predetermined upward force is applied via the coil tubing to shear the second shear pin, thus releasing the bottom hole assembly from the coiled tubing.

33. The release tool according to claim 32, further comprising:

a collar locator adapted to detect collars in a casing in the well bore to position a bottom hole assembly having packing elements, such that the packing elements straddle a zone to be fraced.

34. The release tool of claim 33 in which the collar locator further comprises:

a collar locator mandrel;

a key mounted within a key retainer and about the collar locator mandrel; and a spring, the spring being located between the collar locater mandrel and the keys to urge the key into contact with the casing.

35. The release tool of claim 34 further comprising a filter in a port to allow the key to move radially when encountering a collar in the casing.

36. The release tool of claim 35 further comprising a seal adapted to allow the collar locator to be utilized during fracing.

37. The release tool of claim 36 in which the key has a leading edge at a first angle and a trailing edge at a second angle, the first angle being such that a resulting axial force may be detected at surface by a coiled tubing operator when inserting the release tool into the well bore, the second angle being such that a resulting axial force may be detected at surface by the coiled tubing operator when removing the release tool into the well bore.

38. A method for dislodging a bottom bole assembly lodged in a well bore, comprising:

providing a release tool to connect the bottom hole assembly to coiled tubing, the release tool in an original position having a fishing neck housing functionally associated with the bottom hole assembly;

a release tool mandrel attached to the coiled tubing and adapted to move axially with respect to the fishing neck housing upon the application of an upward force on the coiled tubing; and a reset mechanism, the reset mechanism functionally associating the fishing neck housing and the release tool mandrel such that a predetermined combination of first upward force may be applied for a corresponding first amount of time without releasing the bottom hole assembly, and such that after the application of the predetermined combination of the first upward force for the first amount of time, the application of a second force will release the bottom hole assembly from the coiled tubing;

applying an initial force to the release tool;

removing the first upward force applied to the coiled tubing to reset the release tool to the original position;

applying a second upward force for a second predetermined time such that the release tool will not return to the original position; and applying a third force to partially disconnect the bottom hole assembly from the coil tubing.

39. The method of claim 38 further comprising:

pulling on the coiled tubing at surface to apply the first predetermined upward force on the release tool, for the first period of time to attempt to release the bottom hole assembly when the bottom hole assembly is lodged in the easing; and releasing the upward force, the release tool returning to the original position.

40. The method of claim 39 in which the step of applying the first upward force further comprises applying an upward force of about 24,000 lbs over string weight.

41. The method of claim 38, further comprising applying up to about 26,000 lbs. pull force over swing weight for up to about 10 minutes.

42. The method of claim 38 in which the step of applying the second upward force for the second predetermined time is selected from the group of applying at least 26,000 lbs. over string weight for over about ten minutes, or applying at least 80,000 lbs. over string weight for over 3 minutes.

43. The method of claim 38 in which the step of applying the third force includes applying 32,000 lbs. pull over string weight.

44. The method of claim 43 further comprising applying a fourth upward force to disconnect the bottom hole assembly from the coiled tubing.

45. The method of claim 44 in which the step of applying the fourth upward force comprises applying 38,000 lbs. pull over string weight.

46. The method of claim 45, further comprising:

providing a collar locator having; and using the collar locator to locate a zone to be fraced so that packing elements may straddle the zone.

47. A release tool to attach coiled tubing to a bottom hole assembly in a well bore, comprising:

a fishing neck housing functionally associated with the bottom hole assembly;

a release tool mandrel attached to the coiled tubing and adapted to move axially with respect to the fishing neck housing upon the application of an upward force on the coiled tubing; and a reset mechanism, the reset mechanism functionally associating the fishing neck housing and the release tool mandrel such that a predetermined combination of a first upward force may be applied for a corresponding first amount of time to the release tool mandrel without releasing the bottom hole assembly, and such that the after the application of the predetermined combination of the first upward force for the first amount of time, the application of a second upward force will release the bottom hole assembly from the coiled tubing, wherein the predetermined combination of first upward force for the corresponding first amount of time includes the combination of the application of approximately up to 15,000 lbs. upward force over string weight for up to about 30 minutes and the predetermined combination of up to about 60,000 lbs. over string weigh for up to about 5 minutes; and a balance piston pressure relief valve to provide fluid communication out of the first chamber and into the well bore.

* * * * *

UNITED STATES PATENT AND TRADEMARK OFFICE

CERTIFICATE OF CORRECTION

PATENT NO. : 7,249,633 B2
APPLICATION NO. : 10/868058
DATED : July 31, 2007
INVENTOR(S) : John Edwards Ravensbergen et al.

It is certified that error appears in the above-identified patent and that said Letters Patent is hereby corrected as shown below:

Col. 18 in claim 1, line 24, change “wiled” to --coiled--.
Col. 18 in claim 1, line 41, change “wilt” to --will--.
Col. 19 in claim 3, line 4, change “sting” to --string--.
Col. 19 in claim 4, line 8, insert a --.-- after “weight”.
Col. 19 in claim 10, line 32, change “weigh” to --weight--.
Col. 19 in claim 17, line 62, change “wit” to --with--.
Col. 20 in claim 24, line 67, delete the “,” after --tubing--.
Col. 21 in claim 26, line 18, change “wiled” to --coiled--.
Col. 21 in claim 27, line 23, change “usc to --use--.
Col. 21 in claim 27, line 30, change “wiled” to --coiled--.
Col. 21 in claim 27, line 56, change “tocontrol” to --to control--.
Col. 23 in claim 39, line 18, change “easing” to --casing--.
Col. 23 in claim 40, line 23, insert a --.-- after “lbs”.
Col. 23 in claim 41, line 25, change “swing” to --string--.
Col. 24 in claim 47, line 31, change “weigh” to --weight--.

Signed and Sealed this

Eighteenth Day of September, 2007

JON W. DUDAS
*Director of the United States Patent and Trademark Office*